US011266188B2

(12) United States Patent
Basta

(10) Patent No.: US 11,266,188 B2
(45) Date of Patent: Mar. 8, 2022

(54) ADJUSTABLE FACE SHIELD

(71) Applicant: Saeda Basta, Covina, CA (US)

(72) Inventor: Saeda Basta, Covina, CA (US)

(73) Assignee: Saeda Basta, Covina, CA (US)

( * ) Notice: Subject to any disclaimer, the term of this patent is extended or adjusted under 35 U.S.C. 154(b) by 0 days.

(21) Appl. No.: 16/905,913

(22) Filed: Jun. 18, 2020

(65) Prior Publication Data

US 2021/0392970 A1 Dec. 23, 2021

(51) Int. Cl.
*A61F 11/00* (2006.01)
*A41D 13/11* (2006.01)

(52) U.S. Cl.
CPC ..... *A41D 13/1184* (2013.01); *A41D 13/1161* (2013.01)

(58) Field of Classification Search
CPC ..... A41D 13/11; A41D 13/1161; A41D 13/1184; A41D 13/1107; A41D 2600/202; A61B 90/05; A61F 9/045; A61F 9/025; A61F 9/04; A61F 9/02; A61F 9/00; A42B 1/0185
USPC ..... 128/857; 2/9, 15
See application file for complete search history.

(56) References Cited

U.S. PATENT DOCUMENTS 2,262,449 A 11/1941 Buegeleisen
2,881,443 A 11/1955 Barker
2,758,307 A * 8/1956 Treiber ..... A61F 9/025 2/9
3,120,002 A 4/1964 Blumenthal
3,214,767 A 11/1965 Weber
3,214,768 A 11/1965 Bohner
3,594,816 A * 7/1971 Webb ..... A42B 3/225 2/10
3,686,690 A 8/1972 Webb
4,210,972 A 9/1980 Baclit
4,701,965 A * 10/1987 Landis ..... A61F 9/02 2/428
4,810,081 A * 3/1989 Mapelli ..... G02B 7/002 351/158
4,843,643 A 7/1989 Parissenti
4,853,974 A 8/1989 Olim
4,864,653 A 9/1989 Landis
4,867,178 A 9/1989 Smith
4,884,296 A 12/1989 Nix, Jr.
4,944,312 A 7/1990 Smith
4,965,887 A 10/1990 Paoluccio
5,088,114 A 2/1992 Salce
(Continued)

*Primary Examiner* — Victoria J Hicks

(57) ABSTRACT

The invention is a face shield that is adjustable to accommodate use of a variety of tools often employed in scientific or medical settings, including for example in dentistry. In some embodiments, the adjustable face shield may include a headband for securing the face shield to a head, a brim extension adapted to receive a transparent shield, and a brim frame extending from the headband, the brim frame including a channel adapted to register with a support member of the brim extension at an anterior region of the brim frame, wherein the support member of the brim extension telescopically extends and retracts within the channel from the anterior region of the brim frame to adjust a length of the adjustable face shield. In this manner, the face shield is adjustable to protect the wearer as well as the equipment that may be worn during certain tasks.

20 Claims, 16 Drawing Sheets

(56) References Cited

U.S. PATENT DOCUMENTS

| | | | | | |
|---|---|---|---|---|---|
| 5,247,706 | A * | 9/1993 | Mark | A61F 9/025 | 2/13 |
| 5,469,229 | A * | 11/1995 | Greenbaum | A61F 9/025 | 2/15 |
| 5,647,060 | A | 7/1997 | Lee | | |
| 5,692,522 | A * | 12/1997 | Landis | A61F 9/02 | 128/857 |
| 6,016,808 | A * | 1/2000 | Landis | A61F 9/045 | 128/857 |
| 6,996,846 | B1 | 2/2006 | Karapetyan | | |
| 7,398,560 | B1 | 7/2008 | Swensen | | |
| 7,490,359 | B2 | 2/2009 | Landis | | |
| 7,937,775 | B2 | 10/2011 | Manzella | | |
| 8,291,512 | B2 * | 10/2012 | Stoll | A41D 13/1184 | 2/15 |
| 9,532,617 | B2 | 1/2017 | Miller | | |
| 9,885,465 | B2 | 2/2018 | Nguyen | | |
| 10,455,871 | B2 | 10/2019 | Pearce | | |
| 2011/0265236 | A1 * | 11/2011 | Stoll | A41D 13/1184 | 2/9 |
| 2012/0069445 | A1 | 3/2012 | Kobayashi | | |
| 2015/0019312 | A1 | 1/2015 | Nguyen | | |
| 2016/0353815 | A1 | 12/2016 | Nabai | | |

* cited by examiner

FIG. 4
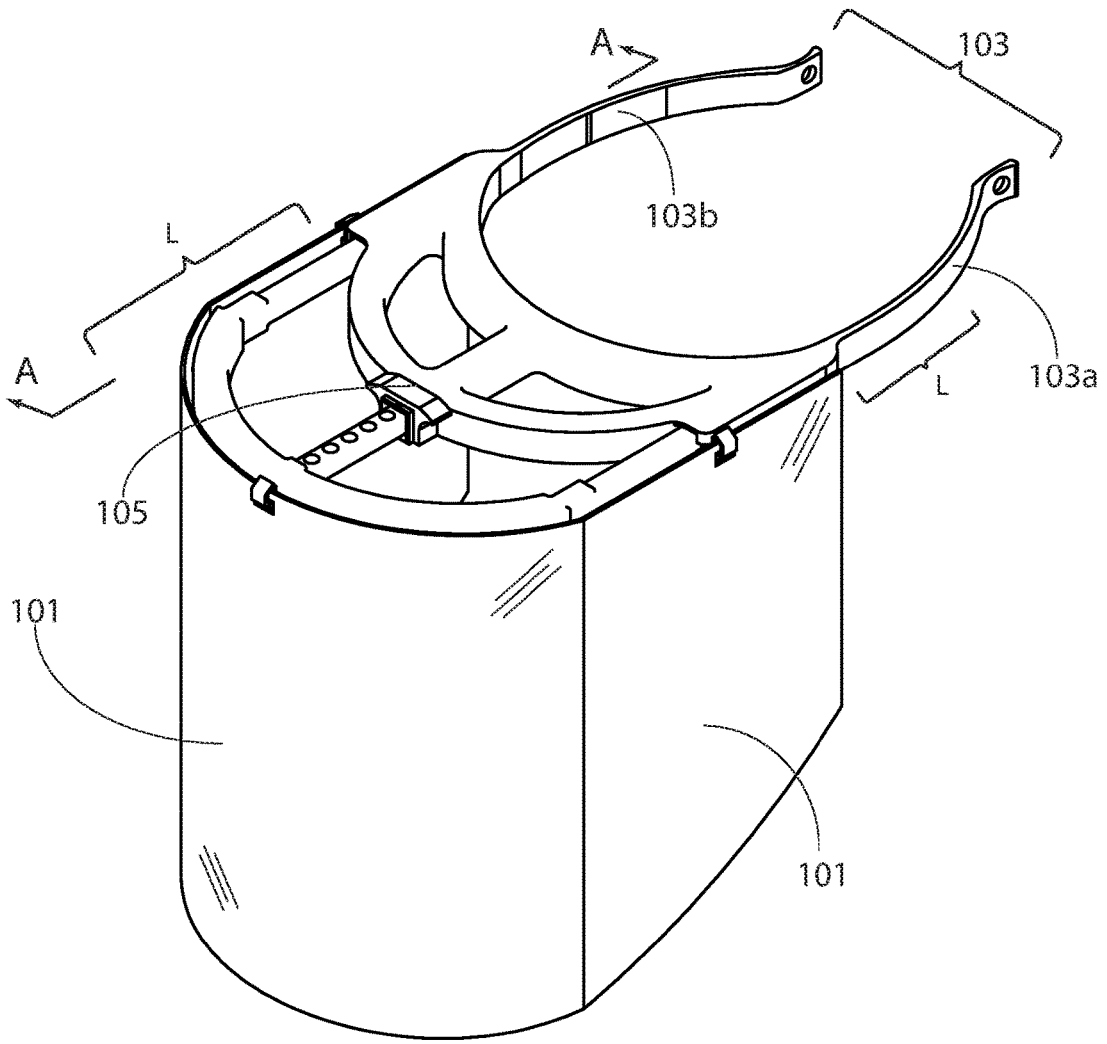
FIG. 5
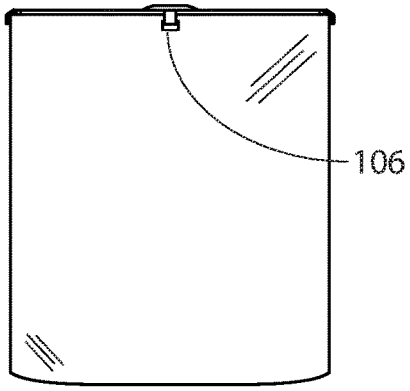
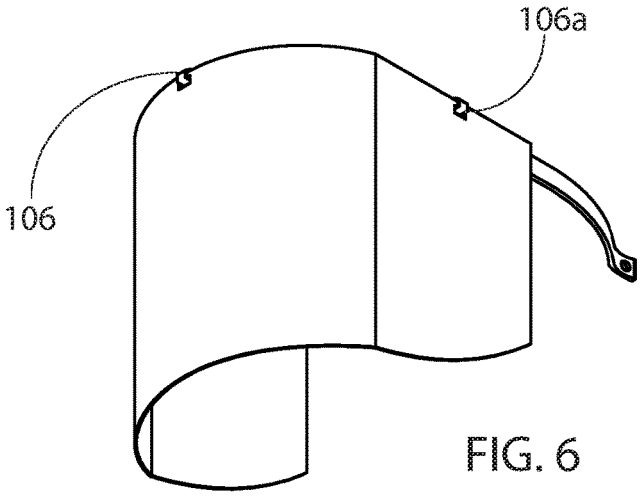
FIG. 6

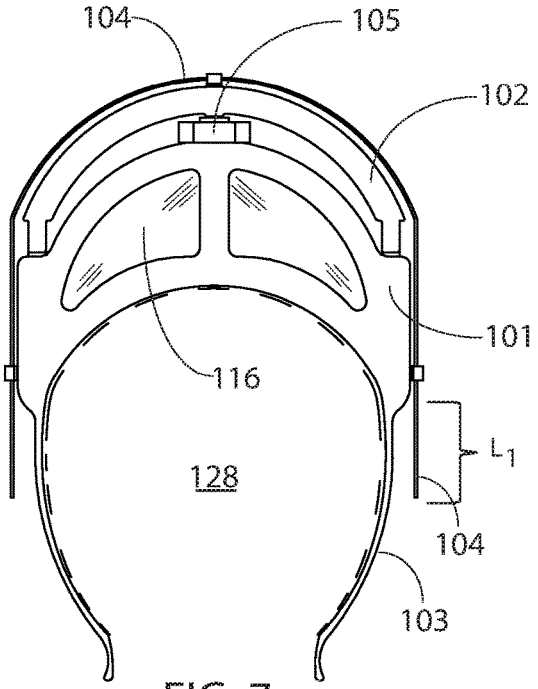
FIG. 7
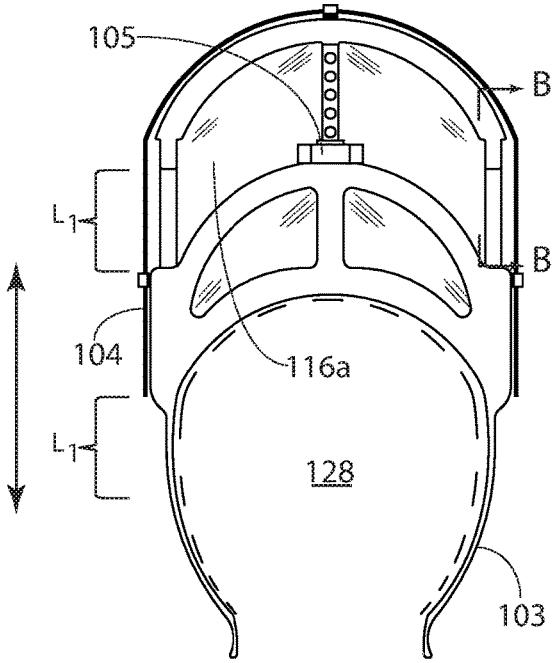
FIG. 9
FIG. 8
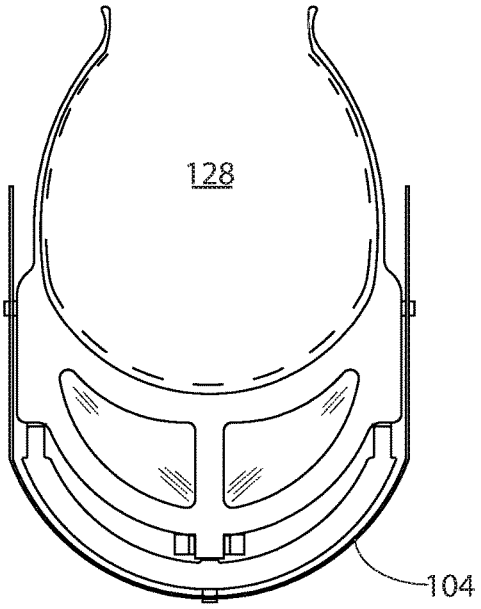
FIG. 10
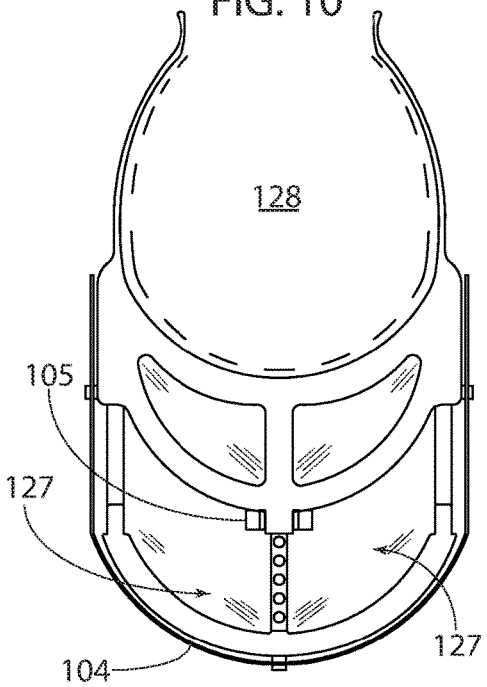

ADJUSTABLE FACE SHIELD

TECHNICAL FIELD OF THE INVENTION

The present disclosure relates to face shields. Specifically, the present disclosure relates to a novel face shield that is adjustable in order to accommodate use of the face shield with a variety of tools often employed in scientific or medical settings, including for example in dentistry.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

The prior art is riddled with face shields of all types—including face shields as sporting equipment, face shields as protective wear for different trades such as machining, welding, medicine, dentistry, and other uses in a variety of fields. Accordingly, face shields are employed as personal protective equipment (PPE), which aims to protect the wearer's entire face (or part of it) from hazards such as flying objects and road debris, chemical splashes (in laboratories or in industry), or potentially infectious materials (in medical and laboratory environments). In medical applications, a face shield protects a medical professional during a procedure that might expose them to blood or other potentially infectious fluids; this is of course true in the dentistry profession as well, where a practitioner may be exposed to blood and fluids directly from a patient's mouth.

One problem that has not been adequately addressed by the prior art, is how to properly secure a face shield that protects the wearer's face but also the wearer's equipment that may be required while wearing a face shield. For example, during surgical procedures—including in a dentistry setting or also with other medical procedures—equipment such as headlights or headlamps, loupes or surgical loups, loups with a fixed extra oral headlights, loups with cameras or video cameras, loups with some or all of the above, and or other fixtures or accessories must be worn or employed by the practitioner in order to conduct the procedure. Often, this equipment must be placed outside of the face shield since face shields typically do not accommodate for the added equipment that must be coupled to the practitioner's face area. Loupes for example, are often worn so that they are in close proximity to the practitioner's eyes and face. Headlights or headlamps are similarly worn on or above the face area—typically around the forehead. Moreover, some equipment requires accessories (battery packs, attachments, etc.) that further add bulk to the space between the wearer's face and face shield. With regards to loupes for example, it is known that accessories such as lamps and video cameras may be desirably used during a procedure. As such, it is desirable that the equipment itself as well as any accessories for the equipment may be worn with a face shield so that the face shield protects the equipment as well as the accessories. Although some face shields may employ attachments so that the equipment or accessories may be worn on an exterior of the face shield, this means that the equipment and or accessories is not protected from the fluids that may be expelled during the procedure. Other face shields may provide some compatibility with external equipment, but those devices are not easily adjustable for the practitioner and thus protection for the equipment accessories is not adequately addressed.

Therefore, there is a need to develop an improved face shield that is adjustable in a manner that allows the wearer to wear or use equipment, protects the wearer as well as the equipment, is easy to adjust, and generally solves the above-mentioned problems. It is to these ends that the present invention has been developed.

SUMMARY OF THE INVENTION

The teachings disclosed herein relate to a novel face shield that is adjustable in order to accommodate use of the face shield with a variety of tools often employed in scientific or medical settings, including for example in dentistry.

In one example, an adjustable face shield is provided. The adjustable face shield may comprise a headband for securing the face shield to a wearer's head; a brim extension adapted to receive a transparent shield; and a brim frame extending from the headband, the brim frame including a channel adapted to register with a support member of the brim extension at an anterior region of the brim frame, wherein the support member of the brim extension telescopically extends and retracts within the channel from the anterior region of the brim frame to adjust a length of the adjustable face shield.

In another example, an adjustable face shield is provided. The adjustable face shield may comprise a headband for securing the face shield to a wearer's head; a brim extension; a transparent shield removably coupled to the brim extension; and a brim frame extending from the headband, the brim frame including a channel adapted to register with a support member of the brim extension at an anterior region of the brim frame, wherein the support member of the brim extension telescopically extends and retracts within the channel from the anterior region of the brim frame to adjust a length of the adjustable face shield.

In yet another example, an adjustable face shield is provided. The adjustable face shield may comprise a headband for securing the face shield to a wearer's head; a brim extension adapted to receive a removable transparent shield, the brim extension including a shield support adapted to receive the transparent shield, a pair of arms extending posteriorly from terminal ends of the shield support, and a support member extending posteriorly from a center region of the shield support; and a brim frame including a posterior support, an anterior support, and a central support situated at a center region of the brim frame connecting the posterior support to the anterior support, wherein the central support houses a channel adapted to receive the support member of the brim extension, wherein the support member of the brim extension telescopically extends and retracts within the channel from the anterior region of the brim frame to adjust a length of the adjustable face shield.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

The adjustable face shield as disclosed herein is further described in terms of exemplary embodiments. These embodiments are described in detail with reference to the drawings, which have not necessarily been drawn to scale, in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows:

FIG. 4 illustrates a perspective view of an adjustable face shield, in an expanded position, in accordance with some exemplary embodiments of the present invention.

FIG. 5 illustrates a front view of an adjustable face shield in accordance with some exemplary embodiments of the present invention.

FIG. 6 illustrates a bottom perspective view of an adjustable face shield, in an expanded position, in accordance with some exemplary embodiments of the present invention.

FIG. 7-FIG. 8 illustrate top and bottom views, respectively, of an adjustable face shield, in a collapsed position, in accordance with some exemplary embodiments of the present invention.

FIG. 9-FIG. 10 illustrate top and bottom views, respectively, of an adjustable face shield, in an expanded position, in accordance with some exemplary embodiments of the present invention.

DETAILED DESCRIPTION OF THE INVENTION

Figure 1:
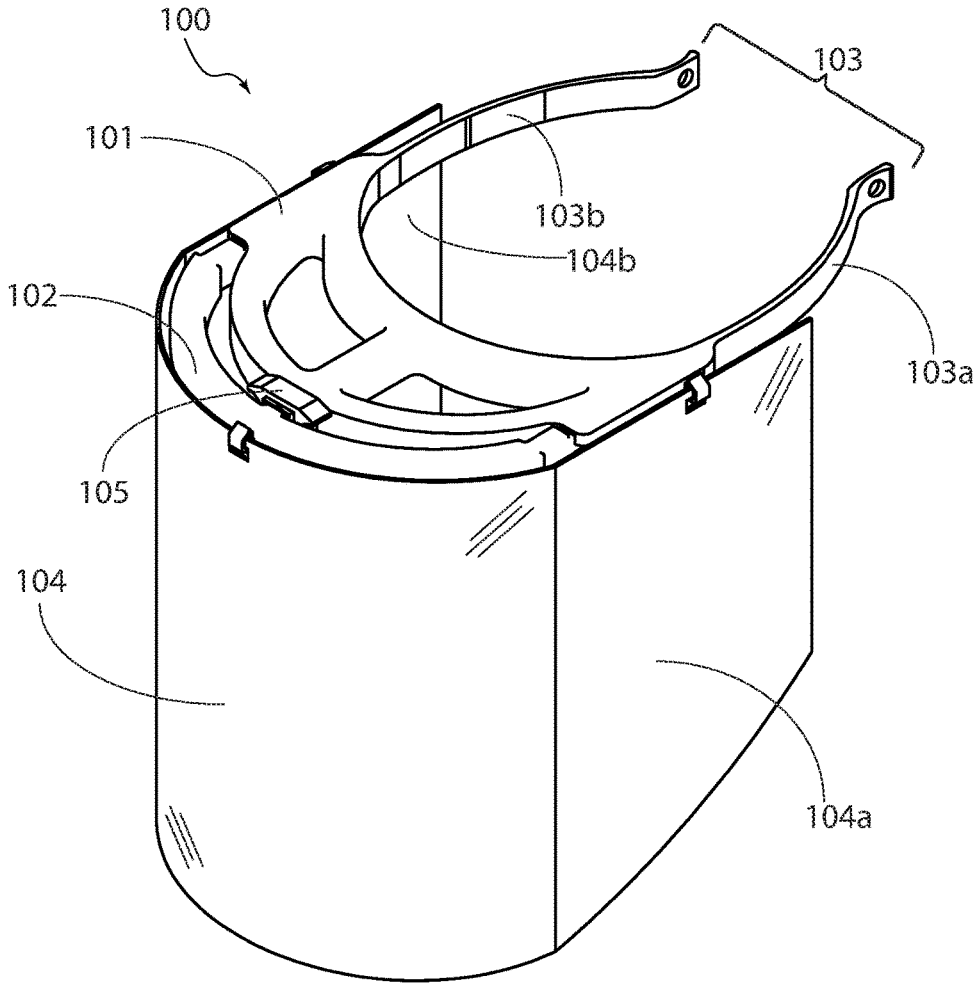
FIG. 1 illustrates a perspective view of an adjustable face shield in accordance with some exemplary embodiments of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Figure 2:
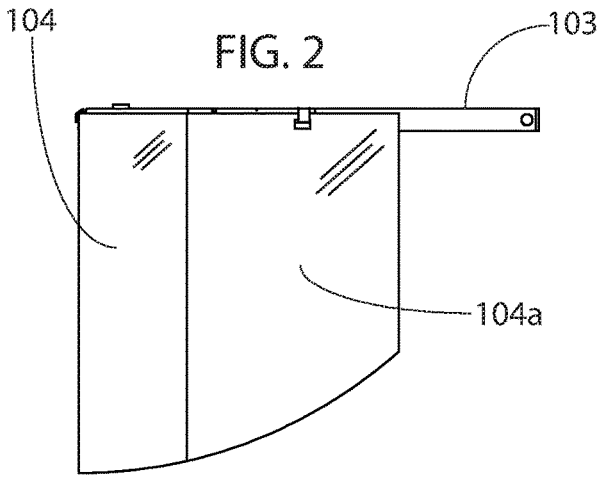
FIG. 2 illustrates a side view of an adjustable face shield in accordance with some exemplary embodiments of the present invention.
Figure 3:
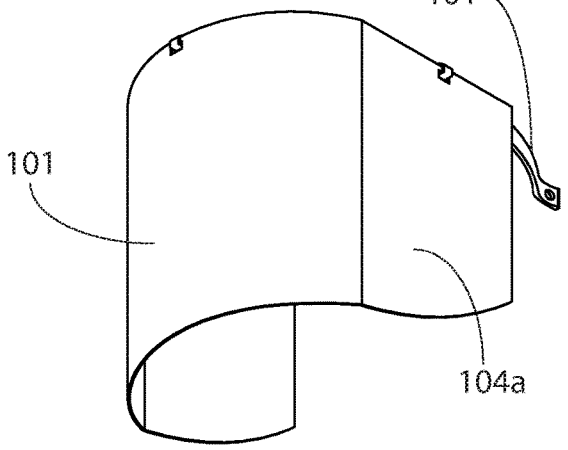
FIG. 3 illustrates a bottom perspective view of an adjustable face shield in accordance with some exemplary embodiments of the present invention.

Turning now to the figures, FIG. 1 illustrates a perspective view of an adjustable face shield in accordance with some exemplary embodiments of the present invention; FIG. 2 illustrates a side view thereof; and FIG. 3 illustrates a bottom perspective view thereof. More specifically, these figures show adjustable face shield 100, which generally comprises of an adjustable body or brim frame 101, which includes an extension or brim extension 102, a headband 103, and a transparent shield 104.

Brim frame 101 may be considered the main body of adjustable face shield 100 and is itself an adjustable component in that brim frame 101 enables a length of face shield 100 to be adjusted by a wearer, as will be discussed in more detail below. Brim frame 101 may, for example, facilitate a telescopic extension and retraction of the length of adjustable face shield 100 by telescopically coupling to an extension member such as brim extension 102. In exemplary embodiments, brim frame 101 may be at least partially hollow, or otherwise comprise of one or more channels that receive a portion of brim extension 102. In some exemplary embodiments, such as the one in the presently discussed figures, brim frame 101 comprises a posterior support that may couple to or be integral with headband 103 of adjustable face shield 100, an anterior support that is adapted to receive or couple with brim extension 102, and a central support situated at a center region of the brim frame 101 connecting the posterior support to the anterior support. In such exemplary embodiments, the central support may be hollow so as to form a channel adapted to register with or receive a portion of brim extension 102. In some exemplary embodiments, both the anterior and posterior supports substantially form arches situated on a similar plane; this shape facilitates the brim shape suitable for contouring to a wearer's face and more specifically to the wearer's forehead region much like traditional cap brims or visors extend from the top or head area of the wearer.

Brim extension 102 is generally an extension component of brim frame 101, which may be exemplarily coupled to or removably coupled to a transparent shield (such as shield 104), and which may be retracted into or extended from brim frame 101. As will be discussed further below, in some exemplary embodiments, a user may selectively set or secure a length of the adjustable face shield 100 by selectively setting or securing brim extension 102 at a particular predetermined length along a telescopic pathway between brim extension 102 and brim frame 101. In some exemplary embodiments, such as the one in the presently discussed figures, brim extension 102 comprises a shield support adapted to receive or removably couple to transparent shield 104. Extending posteriorly from the shield support, a pair of arms may provide additional support to the transparent shield. Moreover, in exemplary embodiments, a support member may be employed by brim extension 102 for registering with a portion of brim frame 101 and facilitating the extension and retraction of brim extension 102 within a portion of brim frame 101.

Headband 103 may be formed in a variety of ways without deviating from the scope of the present invention. In FIGS. 1-3, for example and in no way limiting the scope of the present invention, headband 103 is generally formed as an integral component of brim frame 101, via a pair of arms 103*a*, 103*b* that extend at opposite posterior regions of brim frame 101, wherein each of the arms extends from the most posterior regions of the posterior support of brim frame 101 thereby forming an aperture 128 suitable for receiving or engaging with the head of a wearer (see FIG. 7-FIG. 10 showing area marked partially with dotted lines to indicate the aperture 128). In other exemplary embodiments, see for example FIG. 40-FIG. 41 described in more detail below, a headband may include a strap that may be secured to the wearer's head, wherein the strap engages with a portion of brim 101 in order to control a size of the aperture suitable for receiving or engaging with the head of a wearer. In exemplary embodiments, however, such as the embodiment in FIGS. 1-3, headband excludes a strap. Instead, the flexible arms of headband 103 may be tightened by a string or strap or band that may be threaded through small apertures at terminal ends of the headband's arms. This embodiment allows adjustable face shield 100 to be more readily sed by individuals with long hair that may need to place their hair in a bun or ponytail.

Transparent shield 104 may be any type of shield that is transparent or translucent in order to allow a wearer to see what they are doing, but also that is suitable for protecting the wearer from debris and fluids to which the wearer may be exposed during use of adjustable face shield 100. Depending on the purpose of adjustable face shield 100, materials may include but are not limited to Polycarbonate (PC), Propionate (PROP), Acetate, or PETG. For example, and without limiting the scope of the present invention, PC provides good impact and heat resistance. Although not very chemical resistant, some PC face shields provide resistance to chemicals depending on thickness and coatings. Ultraviolet (UV) filter additives can also be added to provide UV protection. PROP may be ideal for protection against chemical splashes. Acetate enables good scratch and chemical resistance but often sacrifices visibility. PETG offers excellent chemical splash protection. As may be appreciated by a person of ordinary skill in the art, one or more materials may be incorporated in other to achieve the desired utility. For example, a solid PC transparent shield should be suitable for those in the medical and dentistry fields that are looking for good visibility while protecting themselves from fluids that may be expelled from the tools and or the patient's the practitioners are treating while wearing adjustable face shield 100. In some exemplary embodiments, transparent shield 104 may incorporate one or more coatings. For example, and without limiting the scope of the present invention, in some exemplary embodiments, transparent shield 104 may include an anti-fog coating to prevent fogging due to water vapor while in use. In some exemplary embodiments, transparent shield 104 may include an anti-scratch coating to prevent damage and or prolong the life of transparent shield 104. In some exemplary embodiments, transparent shield 104 may include a reflective coating to reflect and dissipate radiant heat, which may be useful when working in certain environments. In some exemplary embodiments, transparent shield 104 may include a polarized coating to improve visibility during certain procedures. In some exemplary embodiments, transparent shield 104 may implement protective optical coating materials configured to protect the wearer from lasers or similar tools that may emit harmful wavelength of light. As such, in some exemplary embodiments, transparent shield 104 may include UV coating technology suitable for addressing wavelengths that may be harmful.

As mentioned above, transparent shield may be permanently attached to or removably attached to brim extension 102 of adjustable face shield 100. One advantage of employing a removable shield is of course the easy with which a damage shield may be replaced, or a shield with one type of coating or designed for one type of purpose may be exchanged for another type of shield—for example, a transparent shield may be exchanged for a shield that comprises a UV coating for protecting the wearer during certain procedures such as laser-based procedures. As such, in some exemplary embodiments, transparent shield 104 may be preferably removable from brim extension 102.

Embodiments in which transparent shield 104 is removable may be especially useful so that different types of transparent shields may be used with the same adjustable face shield 100. This presents the advantage that the practitioner avoids having to purchase special filters for their own equipment. Using an example mentioned above, in dentistry, loupes are often used with accessories including certain filters that protect practitioner's eyes during laser procedures. Many manufacturers of loupes will require their own filters. Similarly, some models of loupes, which are often custom-made, will require custom or specialized filters that will be compatible with the specific loupe model or design. With the present invention, the practitioner may avoid purchasing specialized or model-specific filters with the adequate optical coatings suitable for protecting the practitioner from harmful wavelength emissions during laser procedures. Instead, with the current invention, the practitioner may simply swap a regular transparent shield 104 with a similar transparent shield 104 that has been treated with a protective optical coating.

Moreover, because transparent shield 104 may be considered the primary component protecting the wearer's face, transparent shield 104 generally wraps around a perimeter of adjustable face shield 100. As may be appreciated from the views of FIGS. 1-3, when worn by a wearer, the wearer's face including their ears will be adequately covered by transparent shield 104. As such, in exemplary embodiments, transparent shield 104 includes lateral regions 104*a* and 104*b* which cover the sides of a wearer's face. In exemplary embodiments, transparent shield 104 (including lateral regions 104*a* and 104*b*) may comprise a single piece shield, while in other exemplary embodiments, lateral regions 104*a* and 104*b* may be separate transparent shield units coupled together.

The extendibility of transparent shield 104 from a regular collapsed position (as shown in FIGS. 1-3) to a fully extended position (as shown in FIGS. 4-6, and discussed in turn below) enables adjustable face shield 100 to be adjusted for accommodating and properly securing a wearer's additional equipment. For example, and without limiting the scope of the present invention, during surgical procedures—including in a dentistry setting or also with other medical procedures—equipment such as loupes must be employed by the practitioner in order to conduct the procedure. Often, the equipment—such as loupes—must be placed outside of the face shield since face shields typically do not accommodate for the added equipment that must be coupled to the practitioner's face area. Loupes, for example, are often worn so that they are in close proximity to the practitioner's eyes and face. Although some face shields may employ attachments so that the equipment may be worn on an exterior of the face shield, this means that the equipment is not protected from the fluids that may be expelled during the procedure. Other face shields may provide some compatibility with external equipment, but those devices are not easily adjustable for the practitioner. On the other hand, adjustable face shield 100 extends and retracts in order to adjust to and accommodate such tools within the protected area behind transparent shield 104.

Accordingly, in exemplary embodiments, adjustable face shield 100 comprises: a headband 103 for securing the face shield to a wearer's head; a brim extension 102 adapted to receive a transparent shield 104; and a brim frame 101 extending from the headband 103, the brim frame 101 including a channel adapted to register with a support member of the brim extension 102 at an anterior region of the brim frame 101, wherein the support member of the brim extension 102 telescopically extends and retracts within the channel from the anterior region of the brim frame 101 to adjust a length of the adjustable face shield.

Turning now to the next set of figures, FIG. 4 illustrates a perspective view of adjustable face shield 100, in an expanded or extended position, in accordance with some exemplary embodiments of the present invention; FIG. 5 illustrates a front view thereof; and FIG. 6 illustrates a bottom perspective view thereof. From these views, it may be appreciated how in some exemplary embodiments brim extension 102 telescopically extends from brim frame 101 in order to increase a length L (and therefore an area within the interior region of adjustable face shield 100) to enable a user to select one of a plurality of discrete length adjustment settings of the brim extension so as to accommodate for tools such as loupes worn by practitioner during a procedure. In exemplary embodiments, to secure the face shield at a desired length, a securing mechanism 105 may be employed. For example, and without limiting the scope of the present invention, securing mechanism 105 may be a tab that is configured to be selectively set at one of multiple or plurality of discrete adjustment settings of brim extension 102.

As may be appreciated from the views of FIG. 3, FIG. 4, and FIG. 6, when in a full extended or expanded position, transparent shield 104 is moved forward a desirable length L along an overall length of adjustable face shield 100. Because transparent shield 104 is secured to at brim extension 102, for example by way of one or more clasps 106 situated around a perimeter of brim extension 102, extending brim extension 102 moves transparent shield 104 along a length of adjustable face shield 100 and exemplarily along length L.

Turning now to the next set of figures, FIG. 7-FIG. 8 illustrate top and bottom views, respectively, of adjustable face shield 100, in a collapsed position, in accordance with some exemplary embodiments of the present invention; and FIG. 9-FIG. 10 illustrate top and bottom views thereof, respectively, of adjustable face shield 100 in an expanded position. From these views, the adjustability of transparent shield 104 may be better appreciated. When in the collapsed position, as shown in top view of FIG. 7 and bottom view of FIG. 8, a length Li of transparent shield 104 may expand over a portion of headband 103. When in the expanded or extended position, as shown in top view of FIG. 9 and bottom view of FIG. 10, the length Li of transparent shield 104 may be positioned forward so that length Li in the extended position covers a more forward region of headband 103.

Figure 11:
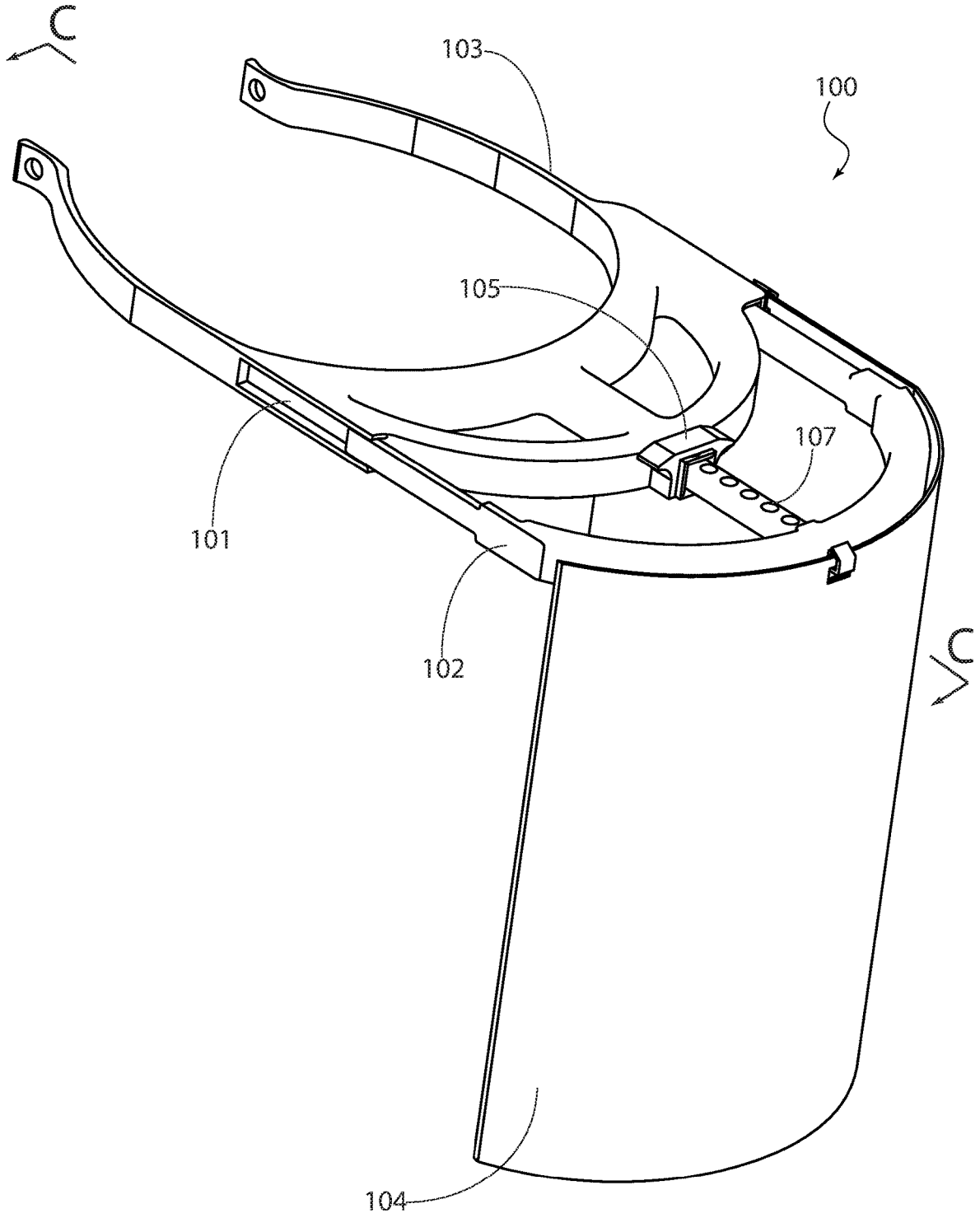
FIG. 11-FIG. 13 illustrate partial cross-sectional perspective views of an adjustable face shield, in an expanded position, in accordance with some exemplary embodiments of the present invention.
Figure 12:
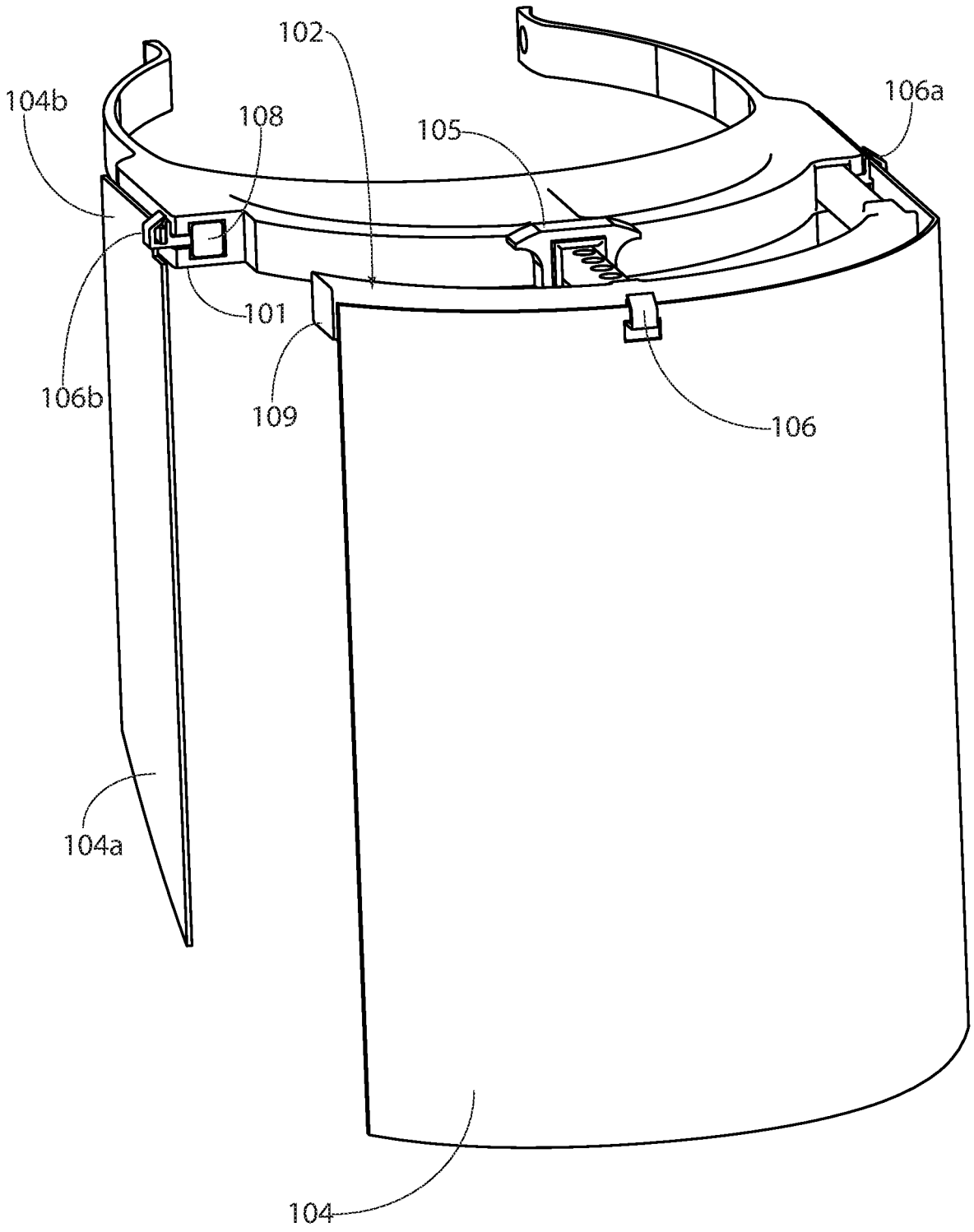
Figure 13:
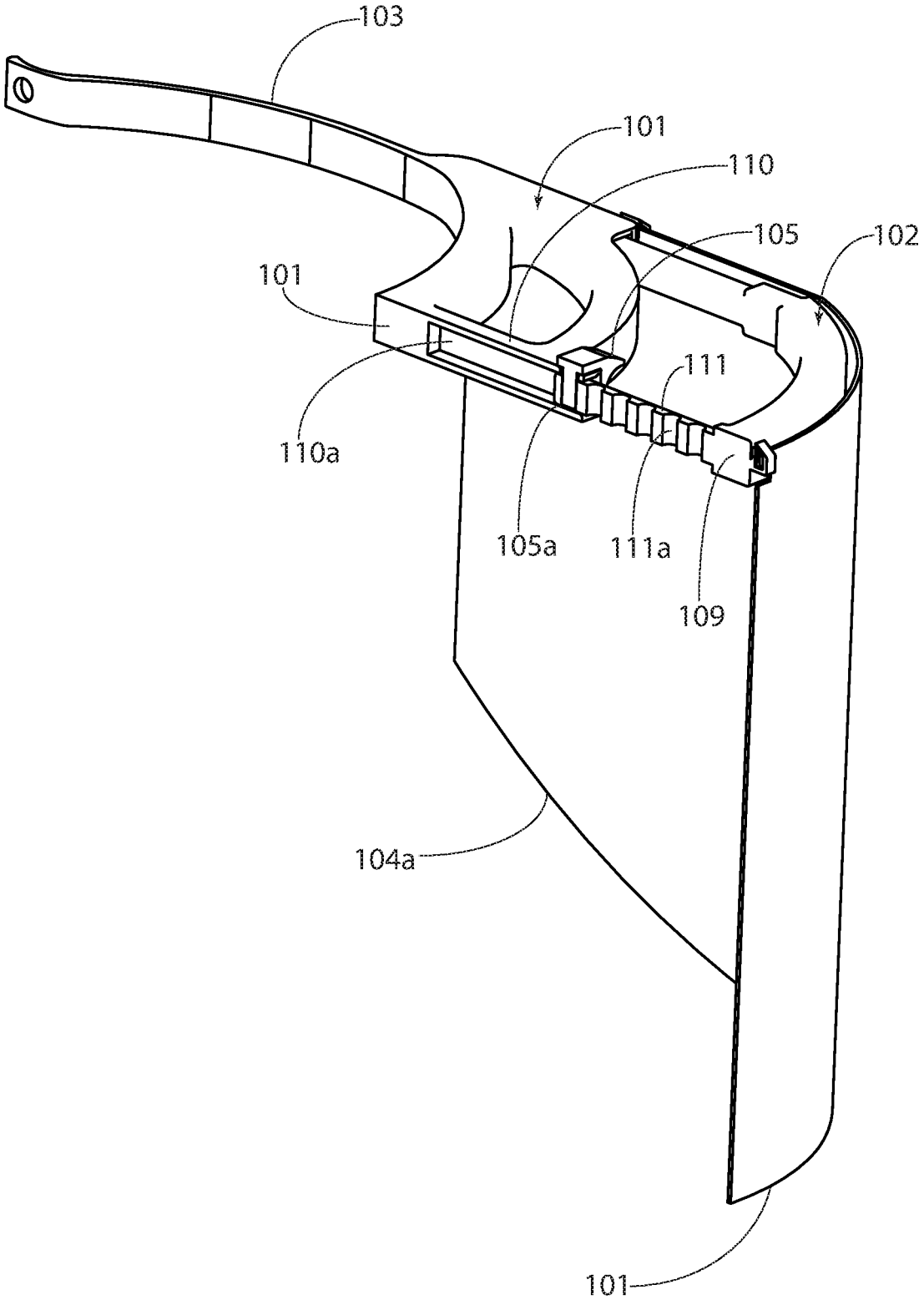

The next set of figures, FIG. 11-FIG. 13, illustrate partial cross-sectional perspective views of adjustable face shield 100, in an expanded position, to better show how certain components—mainly brim frame 101 and brim extension 102—are configured to register with each other in order to achieve a desired adjustability of adjustable face shield 100.

Turning to the first figure, FIG. 11 illustrates a partial cross-sectional perspective view of adjustable face shield 100 along line segment A-A as indicated in FIG. 4. From this view, it may be appreciated that one of the arms of brim extension 102 is received by one of the channels of brim frame 101 so that brim extension 102 fits snuggly within portions of brim frame 101. In this way, at least a portion of brim 102 telescopically extends and retracts within a portion of brim frame 101. In some exemplary embodiments, as shown in these views, in addition to lateral arms that register with brim frame 101, brim extension 102 includes support member 107, which includes a means of selectively securing a length of brim extension 102. Securing mechanism 105, as mentioned above, may be employed to set the desired length, and leave it securely placed at the desired length.

FIG. 12 similarly illustrates a partial cross-sectional perspective view of adjustable face shield 100. In this view, the partial cross-sectional perspective view of adjustable face shield 100 is along line segment B-B as indicated in FIG. 9. From this partial cross-sectional view, an arm 108 extending from shield support 109 of brim extension 102 may be seen registering within a channel on one of the sides of brim frame 101.

In the view of FIG. 13, the partial cross-sectional perspective view of adjustable face shield 100 is along line segment C-C as indicated in FIG. 11, wherein line segment C-C runs along a central region of adjustable face shield 100 (exemplarily symmetrically dividing adjustable face shield 100 in two). From this partial cross-sectional view, it may be appreciated that a channel 110*a* is formed within a central support 110 of brim frame 101, which is configured to receive at least a portion of brim extension 102, and more specifically (in the shown embodiment) support member 111, which extends from a center region or middle portion of shield support 109 of brim extension 102. Moreover, from this view it may be appreciated that support member 111 may include one or more length adjustment settings such as apertures 111*a* formed into the structure of support member 111 for adjusting the length of the face shield. For example, and without limiting the scope of the present invention, securing mechanism 105 may include a length adjustment tab 105*a* (as shown) for securing the brim extension 102 at a selected length when selectively placing the length adjustment tab 105*a* into one of the plurality of apertures 111*a* of support member 111 of brim extension 102.

Accordingly, in some exemplary embodiments, adjustable face shield 100 may comprise: a headband 103 for securing adjustable face shield 100 to a wearer's head; a brim extension 102; a transparent shield 104 removably coupled to the brim extension 102; and a brim frame 101 extending from the headband 104, the brim frame 101 including a channel 110*a* adapted to register with a support member 111 of the brim extension 102 at an anterior region of the brim frame 101, wherein the support member 111 of the brim extension 102 telescopically extends and retracts within the channel 110*a* from the anterior region of the brim frame 101 to adjust a length of the adjustable face shield 100.

Figure 14:
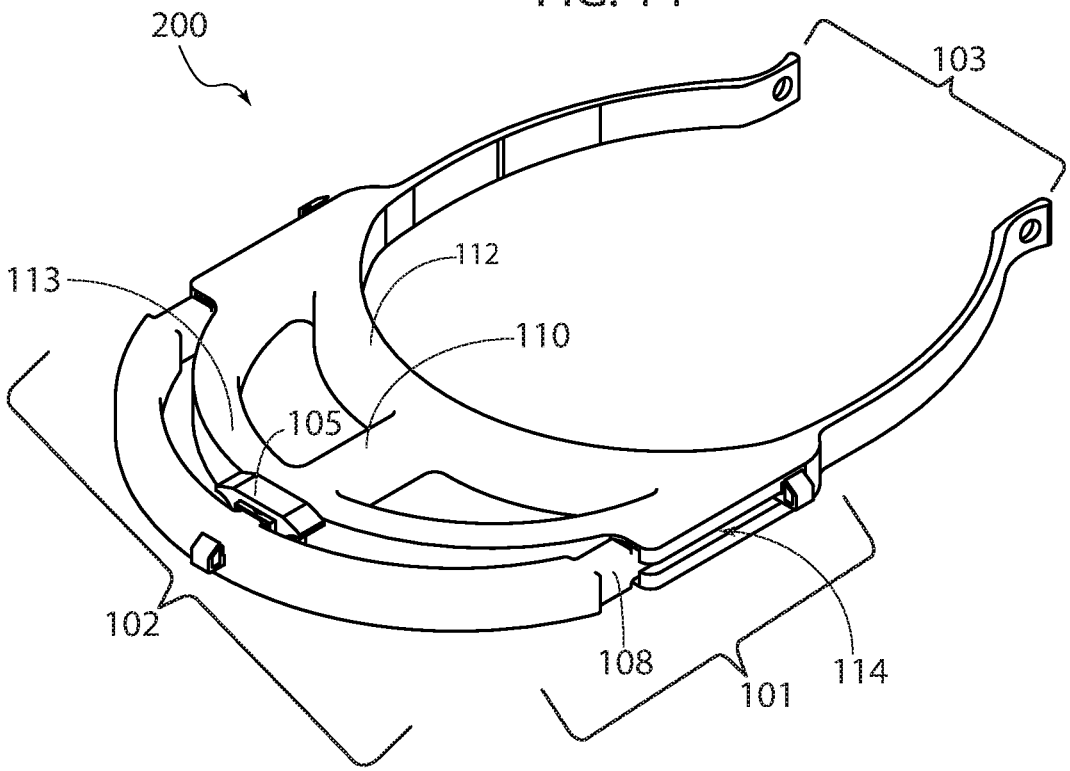
FIG. 14 illustrates a perspective view of an adjustable body for an adjustable face shield, in a collapsed position, in accordance with some exemplary embodiments of the present invention.
Figure 15:
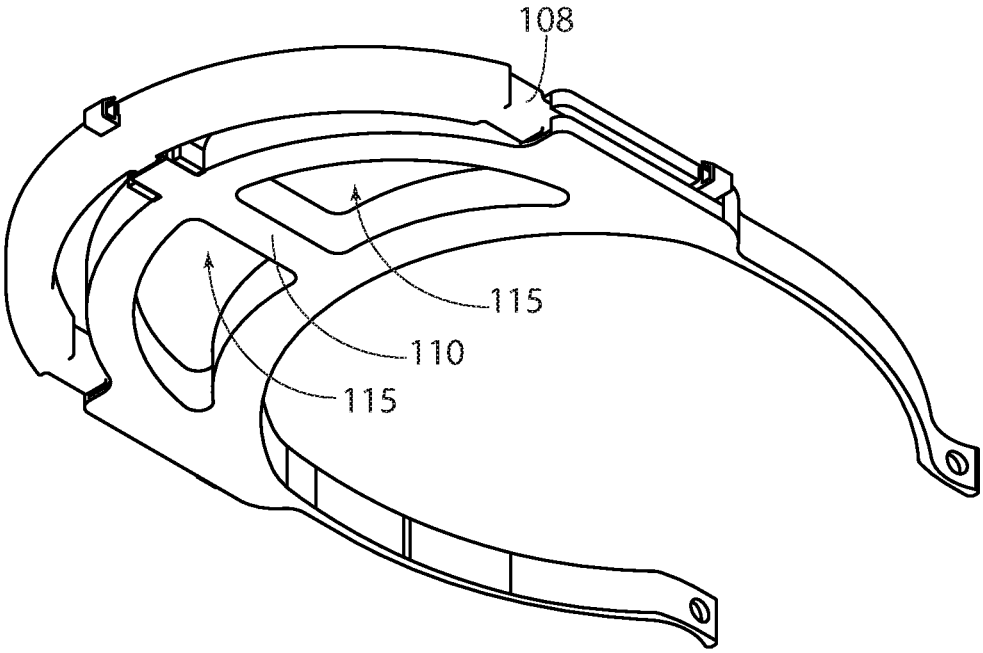
FIG. 15 illustrates a bottom perspective view of an adjustable body for an adjustable face shield, in a collapsed position, in accordance with some exemplary embodiments of the present invention.
Figure 16:
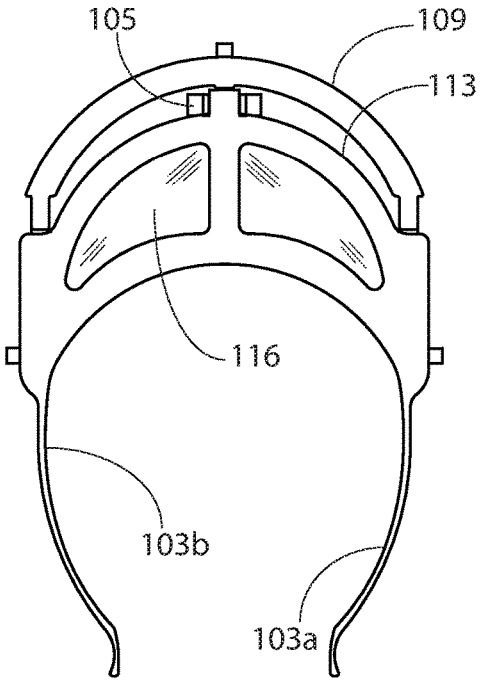
FIG. 16-FIG. 17 illustrate top and bottom views, respectively, of an adjustable body for an adjustable face shield, in a collapsed position, in accordance with some exemplary embodiments of the present invention.
Figure 17:
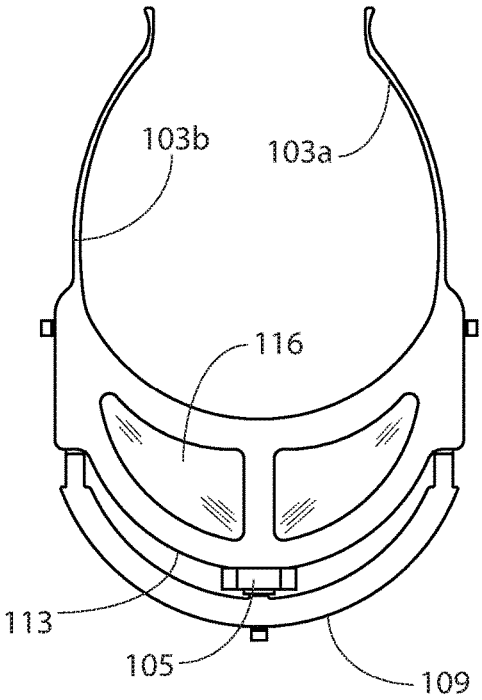
Figure 18:
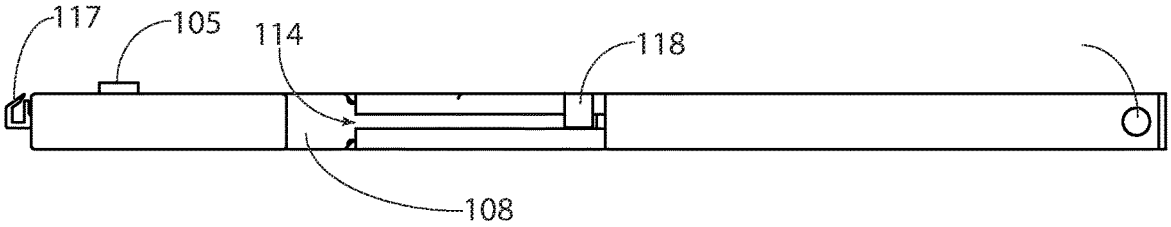
FIG. 18 illustrates a side view of an adjustable body for an adjustable face shield, in a collapsed position, in accordance with some exemplary embodiments of the present invention.
Figure 19:
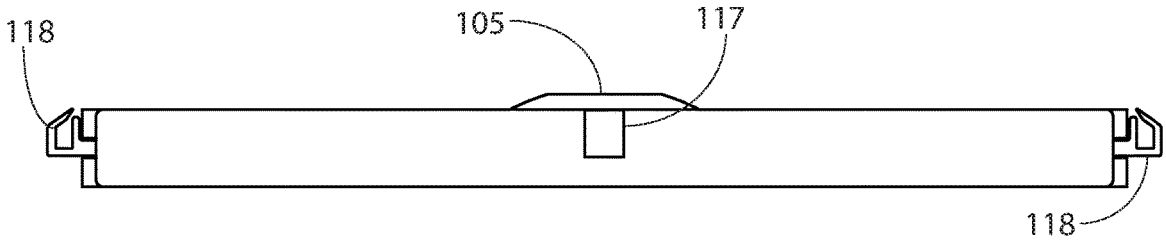
FIG. 19 illustrates a front view of an adjustable body for an adjustable face shield, in accordance with some exemplary embodiments of the present invention.

Now turning to the next set of figures, several views are presented and discussed concerning an adjustable body for an adjustable face shield in accordance with exemplary embodiments of the present invention. More specifically, FIG. 14 illustrates a perspective view of an exemplary adjustable body (or brim frame 101 coupled to brim extension 102) for adjustable face shield 100, in a collapsed position, in accordance with some exemplary embodiments of the present invention; FIG. 15 illustrates a bottom perspective view thereof; FIG. 16-FIG. 17 illustrate top and bottom views, respectively, thereof; FIG. 18 illustrates a side view thereof; and FIG. 19 illustrates a front view thereof.

A shown in these views, the adjustable body (i.e. brim frame 101 coupled to brim extension 102) may be provided without a transparent shield such as transparent shield 104. This may be beneficial in embodiments in which the adjustable body is made to be compatible with existing face shields in the market. Alternative, replaceable transparent shields may be provided by a supplier and thus it may be advantageous to provide the adjustable body to consumers without the transparent face shield. Furthermore, as mentioned above, face shields may be provided with varying layer types or coatings depending on particular uses—for example, in some embodiments an adjustable body for an a adjustable face shield in accordance with the present invention may include a simple clear transparent face shield, and an additional face shield that includes a polarized coating to improve visibility in certain lighting conditions or a UV coating for protecting the wearer during laser-based procedures.

Accordingly, in such embodiments in which an adjustable body may be desirably provided without a transparent face shield, adjustable face shield assembly 200 may comprise of a brim frame 101 and brim extension 102 (without the transparent shield attached). In such exemplary embodiments, brim frame 101 comprises: a posterior support 112 that arches to contour to a wearer's head; an anterior support 113 that arches to contour to the posterior support 112; a central support 110 situated at a center region of the brim frame 101 connecting the posterior support 112 to the anterior support 113, wherein the central support 110 houses a channel 111*a* (not shown in these views, but see FIG. 13) adapted to receive a portion of the brim extension 102 (i.e., support member 111 of the brim extension 102); and exterior channels 114 extending a length of a side region of the anterior support 113, each of the exterior channels 114 adapted to receive an arm 108 of the brim extension 102, wherein the exterior channel 114 is formed by upper and lower walls extending from an upper region and a lower region of the anterior support 113 (see also FIG. 22, FIG. 21 and related discussion below); that is, the encapsulating walls at least partially enclose an exterior region of the anterior support 113 forming each of the side channels or exterior channels 114.

In some embodiments, the posterior support 112 is integral with the headband 103. In some exemplary embodiments, length adjustment tab 105*a* is coupled to the central support 110 for securing the brim extension 102. In some exemplary embodiments, a pair of apertures 115 may be formed adjacent to the central support 110 (see FIG. 15, for example). In some exemplary embodiments, the pair of apertures adjacent to the central support are covered with respective shields 116, 116*a* (see FIG. 7-10, and FIG. 16 and FIG. 17, for example).

With reference to these same figures, and in such embodiments in which an adjustable body may be desirably provided without a transparent face shield, brim extension 102 may comprise of: a shield support 109 adapted to receive the transparent shield 104, the shield support 109 including at least one clasp 117 to secure the transparent shield 104; a support member 111 extending posteriorly from the shield support 109, the support member 111 adapted to register with the channel 110*a* of the brim frame 101, wherein the support member 111 includes one or more length adjustment settings (such as apertures 111*a*) for adjusting the length of the face shield, wherein each of the one or more length adjustment settings is configured to receive a length adjustment tab 105*a* of securing mechanism 105; a pair of arms 108 extending posteriorly from terminal ends of the shield support 109, wherein each of the pair of arms 108 includes one or more lateral clasps 118 extending from a side region of each arm. The side and front views, respectively, of FIG. 18 and FIG. 19 more clearly show how in the exemplary embodiment the plurality of clasps 117, 118 may be disposed throughout a perimeter of assembly 200.

Figure 20:
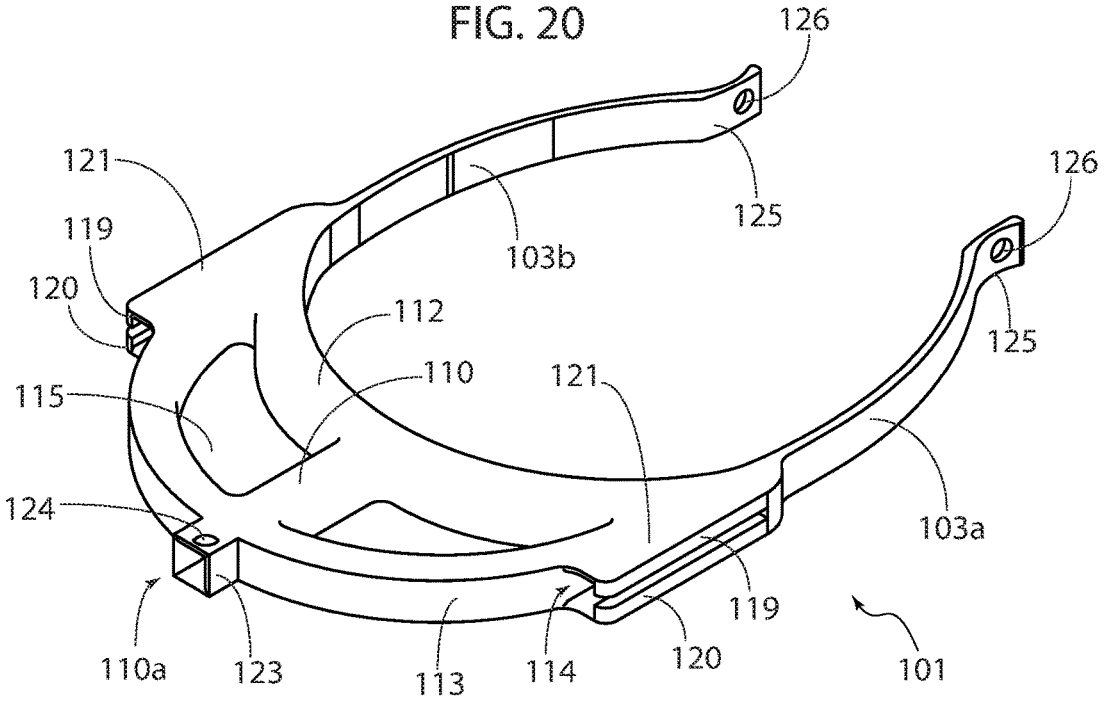
FIG. 20 illustrates a perspective view of a frame for an adjustable face shield in accordance with some exemplary embodiments of the present invention.
Figure 21:
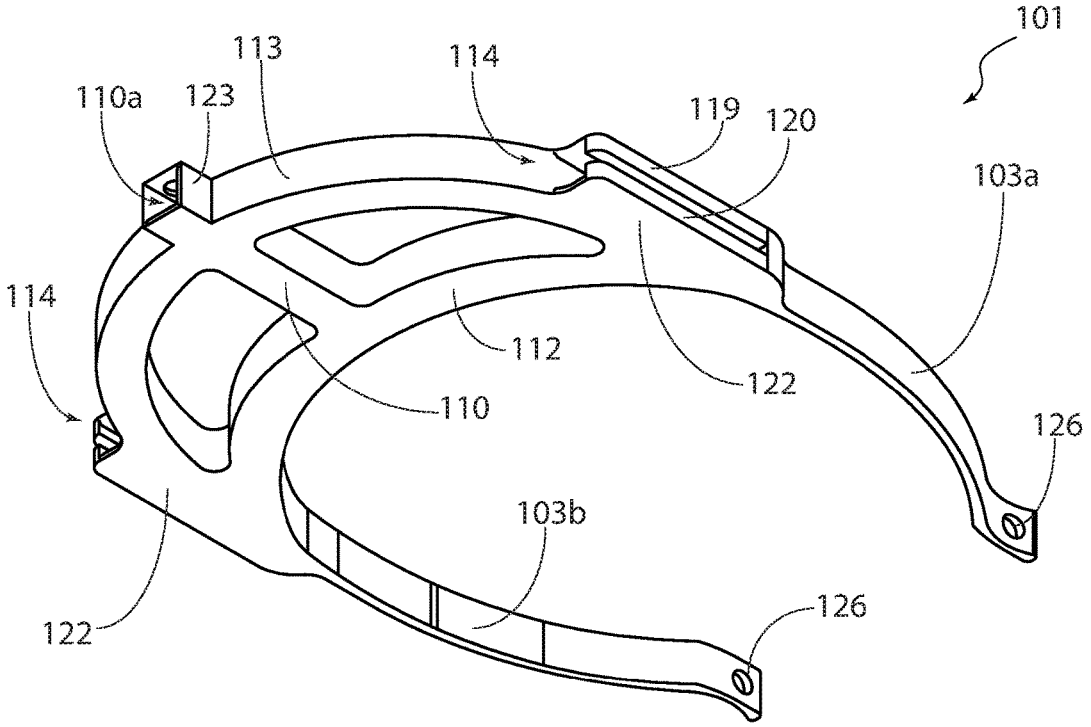
FIG. 21 illustrates a bottom perspective view of a frame for an adjustable face shield in accordance with some exemplary embodiments of the present invention.
Figure 22:
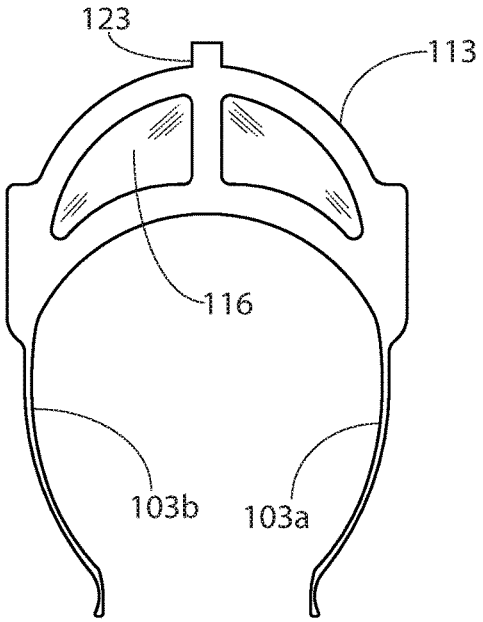
FIG. 22-FIG. 23 illustrate bottom and top views, respectively, of a frame for an adjustable face shield in accordance with some exemplary embodiments of the present invention.
Figure 23:
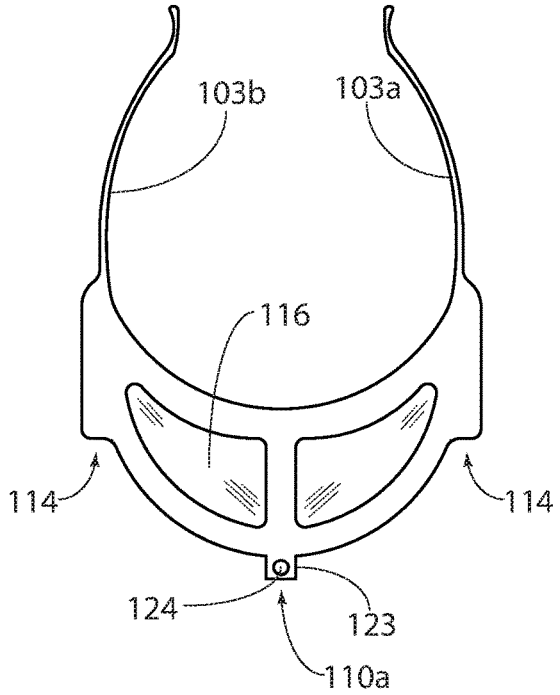
Figure 24:
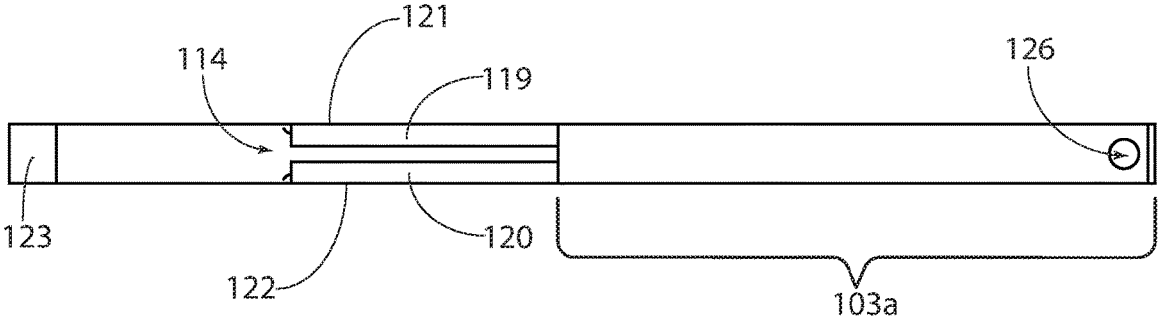
FIG. 24 illustrates a side view of a frame for an adjustable face shield in accordance with some exemplary embodiments of the present invention.
Figure 25:
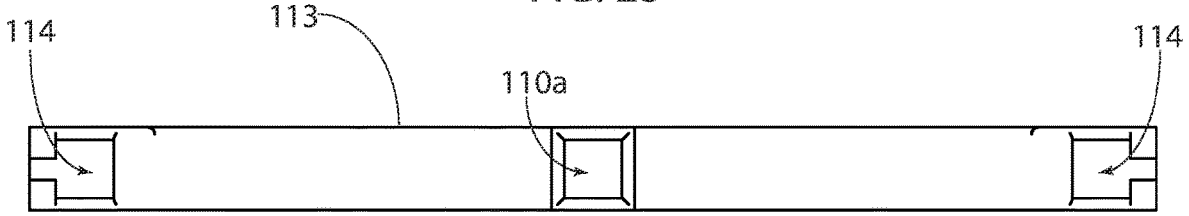
FIG. 25 illustrates a front view of a frame for an adjustable face shield in accordance with some exemplary embodiments of the present invention.

Now turning to the next set of figures, several views are presented and discussed primarily focusing on brim frame 101, in accordance with exemplary embodiments of the present invention. More specifically, FIG. 20 illustrates a perspective view of brim frame 101 without brim extension 102; FIG. 21 illustrates a bottom perspective view thereof; FIG. 22-FIG. 23 illustrate bottom and top views, respectively, thereof; and FIG. 24-FIG. 25 illustrate side and front views, respectively, thereof.

From these views, a few additional details about some exemplary embodiments of brim frame 101 may be better appreciated. For example, and without limiting the scope of the invention in any way, exemplary embodiments of brim frame 101 may achieve telescopic movement of brim extension at an anterior region of the brim frame 101 by implementation of one or more channels that receive at least a portion of the brim extension 102 within. To these ends, channel 110*a* as well as exterior channels 114 extending a length of a side region of the anterior support 113 may be formed, each of the exterior channels 114 adapted to receive an arm of the brim extension 102. In such embodiments, each of the exterior channels 114 may be formed by an extension of an upper surface 121 and a lower surface 122 of the sides of anterior support 113 that join with the terminal ends of posterior support 112. From each of the upper surface 121 and a lower surface 122, walls 119 and 120, respectively, extend to form an encapsulating or partially encapsulating region to each side the anterior support 113. These encapsulating walls, wall 119 (extending downwards from upper surface 121) and wall 120 (extending upwards from lower surface 122) at least partially enclose the side exterior region of the anterior support 113 forming each of the side channels or exterior channels 114 that receive the arms 108 of brim extension 102.

In some exemplary embodiments, as shown, an inlet 123 may be formed at a mouth of channel 110*a* (which as mentioned above is adapted to receive support member 111 of the brim extension 102), in order to facilitate manufacturing and also to structurally support telescoping shields 116*a* that may be placed in order to cover the adjacent cavities 127 that may be formed when brim extension 102 is in an extended position as shown in FIG. 9 and FIG. 10; these telescoping shields 116*a* may be similar to shields 116 that are configured to cover cavities 115, but are structured such that each shield is comprised of several smaller shields placed on top of each other in order to allow for retraction and expansion during use of the adjustable capabilities of the assembly 200. Inlet 123 may further serve as a structural support for securing mechanism 105, and more specifically support an opening 124 that allows a portion of securing mechanism 105 such as tab 105*a* to be threaded there through in order to engage with apertures 111*a* of support member 111 of brim extension 102.

In some exemplary embodiments, and another exemplary detail that may be appreciated from these views, each of the pair of arms 103*a* and 103*b* may include terminal ends 125, which may be flat parallel regions adapted to allow each of the arms 130*a* and 103*b* to be drawn towards each other by way of a string or band that may be inserted through openings 126 on each terminal end 125.

As may be appreciated from the side view of FIG. 24, in some exemplary embodiments, a height of brim frame 101 is constant throughout a length of the brim frame. Conversely, as may be seen in FIG. 30 discussed below, a region of brim extension 102 that registers within channels 114 may include a height that is smaller than a height of the remainder of brim extension 102. From the view of FIG. 25, it may also be gleaned that in some exemplary embodiments, each of the channels 114 and channel 110*a* have openings at an anterior region or front of the brim frame 101, so that brim frame 101 is adapted to receive the brim extension at the anterior of the device; in turn, brim extension 102 is adapted to expand or retract from the forward or anterior of the adjustable face shield assembly 200. FIG. 24's side view also depicts how in some exemplary embodiments, the brim frame 101 may be integral with the headband 103 such that the pair of arms 103*a* and 103*b* simply extend as a continuous expansion of the terminal ends of the brim frame 101.

Figure 26:
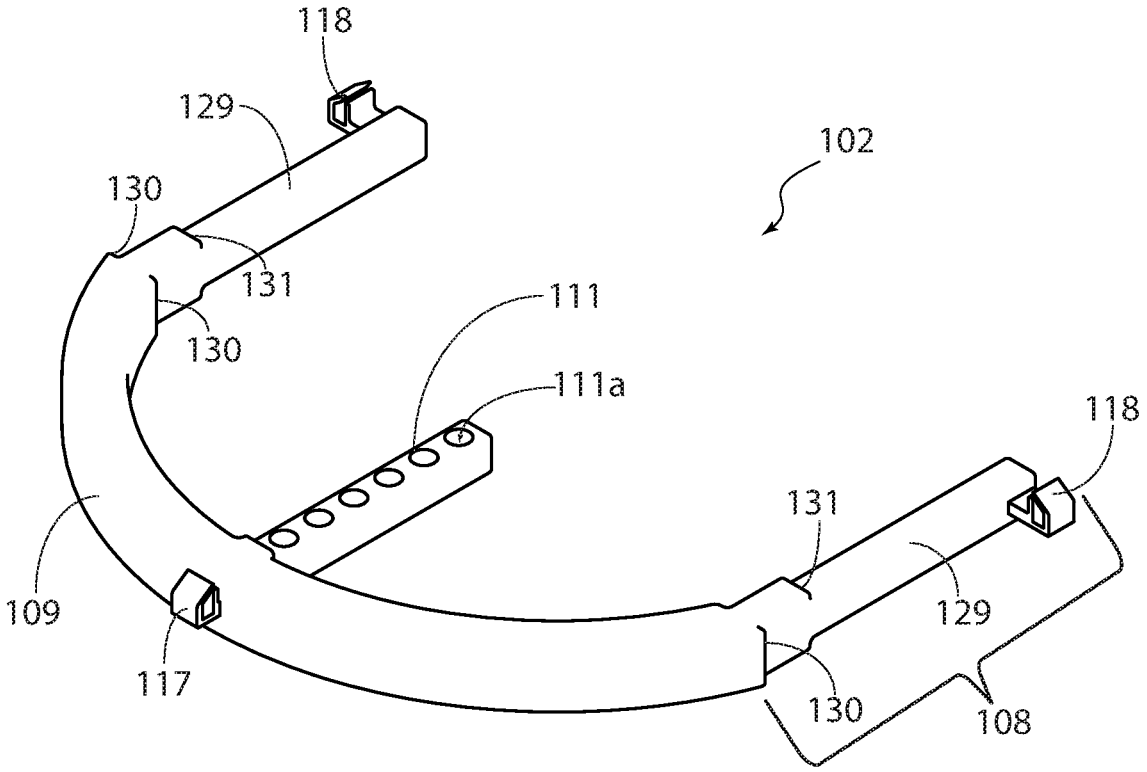
FIG. 26 illustrates a perspective view of a frame extension for an adjustable face shield in accordance with some exemplary embodiments of the present invention.
Figure 27:
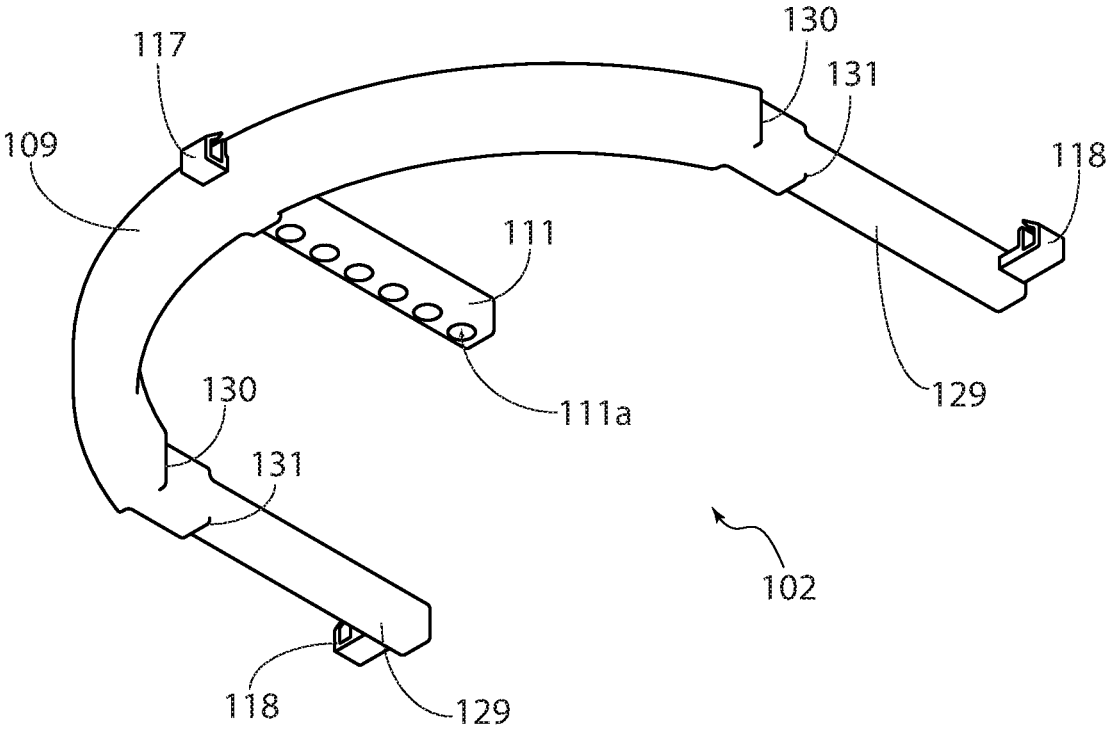
FIG. 27 illustrates a bottom perspective view of a frame extension for an adjustable face shield in accordance with some exemplary embodiments of the present invention.
Figure 28:
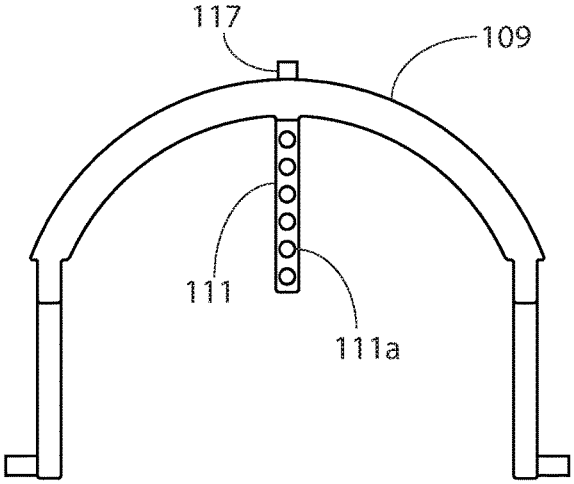
FIG. 28-FIG. 29 illustrate bottom and top views, respectively, of a frame extension for an adjustable face shield in accordance with some exemplary embodiments of the present invention.
Figure 29:
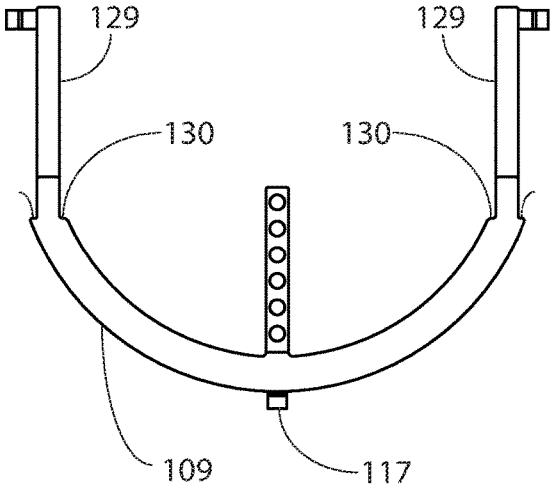
Figure 30:
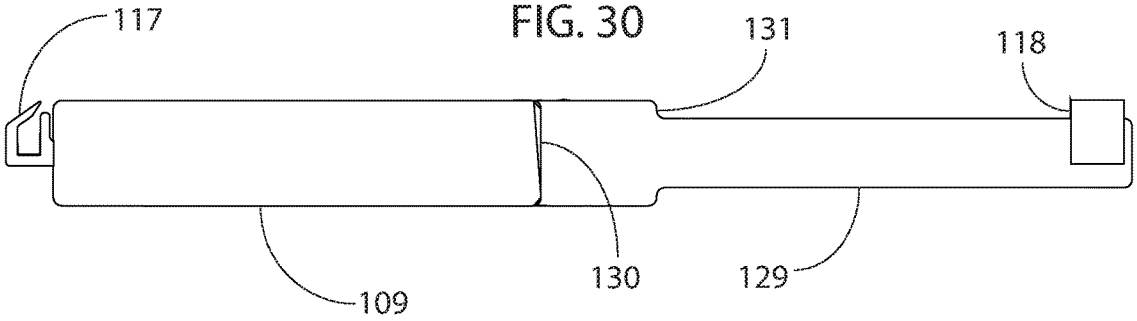
FIG. 30 illustrates a side view of a frame extension for an adjustable face shield in accordance with some exemplary embodiments of the present invention.
Figure 31:
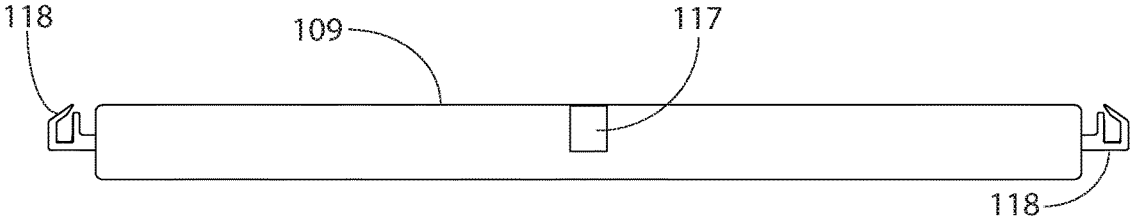
FIG. 31 illustrates a front view of a frame extension for an adjustable face shield in accordance with some exemplary embodiments of the present invention.
Figure 32:
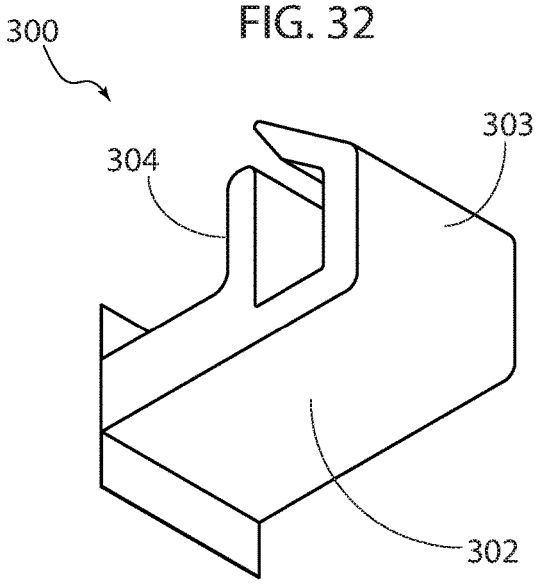

Now turning to the next set of figures, several views are presented and discussed primarily focusing on brim extension 102, in accordance with exemplary embodiments of the present invention. More specifically, FIG. 26 illustrates a perspective view of brim extension 102 without and decoupled from brim frame 101; FIG. 27 illustrates a bottom perspective view thereof; FIG. 28-FIG. 29 illustrate bottom and top views, respectively, thereof; and FIG. 30-FIG. 31 illustrate side and front views, respectively, thereof.

Brim extension is generally a smaller piece that arches and is situated on a substantially similar plane as brim frame 101 (i.e. substantially because at least some portions of brim extension 102 are typically configured to fit inside portions of brim frame 101. The arched shape facilitates the brim shape suitable for contouring to a wearer's face and more specifically to the wearer's forehead region much like traditional cap brims or visors extending from the top or head area of a hat or head cover. Accordingly, shield support 109 generally arches to contour along a perimeter of the anterior support 113 of brim frame 101. As may be appreciated from the views of FIG. 26-FIG. 31, each arm 108 extends from a terminal end 130 of shield support 109 in a manner such that a height of each arm 108 differs than a height or thickness of the shield support 109. Accordingly, in some exemplary embodiments, each arm 108 comprises a length 129 that has a height smaller than a height of the remainder of brim extension 102. In this way, each of the arms, and more specifically lengths 129 of arms 108, may slidably register with the channels 114 of brim frame 101. To allow for a snug fit, a step 131 or height transition region may be implemented to more tightly secure brim extension when situated or coupled within channels 114 of brim frame 101. Moreover, in exemplary embodiments, terminal ends 130 may be slightly wider in order to provide a stop for the portion of brim extension 102 (i.e. length 129 and step 131) that registers inside channels 114 of brim frame 101.

When both components (i.e. brim frame 101 and brim extension 102) are placed together, an adjustable face shield assembly 200 is formed, and in accordance with exemplary embodiments mentioned above, may comprise: a headband 103 for securing the face shield to a wearer's head; a brim extension 102 adapted to receive a removable transparent shield 104, the brim extension 102 including a shield support 109 adapted to receive the transparent shield, a pair of arms extending posteriorly from terminal ends of the shield support, and a support member extending posteriorly from a center region of the shield support; and a brim frame including a posterior support, an anterior support, and a central support situated at a center region of the brim frame connecting the posterior support to the anterior support, wherein the central support houses a channel adapted to receive the support member of the brim extension, wherein the support member of the brim extension telescopically extends and retracts within the channel from the anterior region of the brim frame to adjust a length of the adjustable face shield.

Figure 33:
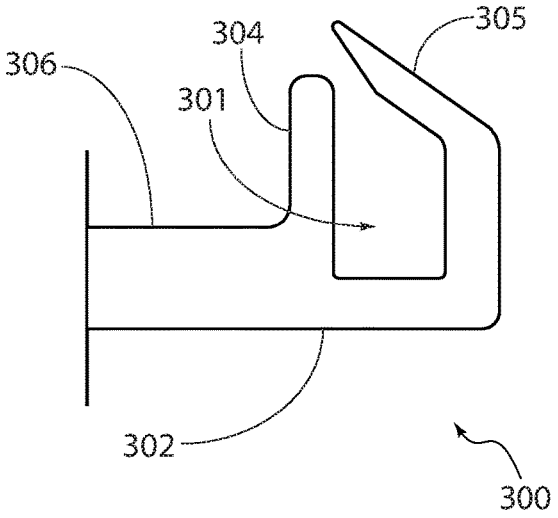
FIG. 33-FIG. 34 illustrate a bottom perspective view, a side view, and top perspective view, respectively, of a shield securing mechanism for an adjustable face shield in accordance with some exemplary embodiments of the present invention.
Figure 34:
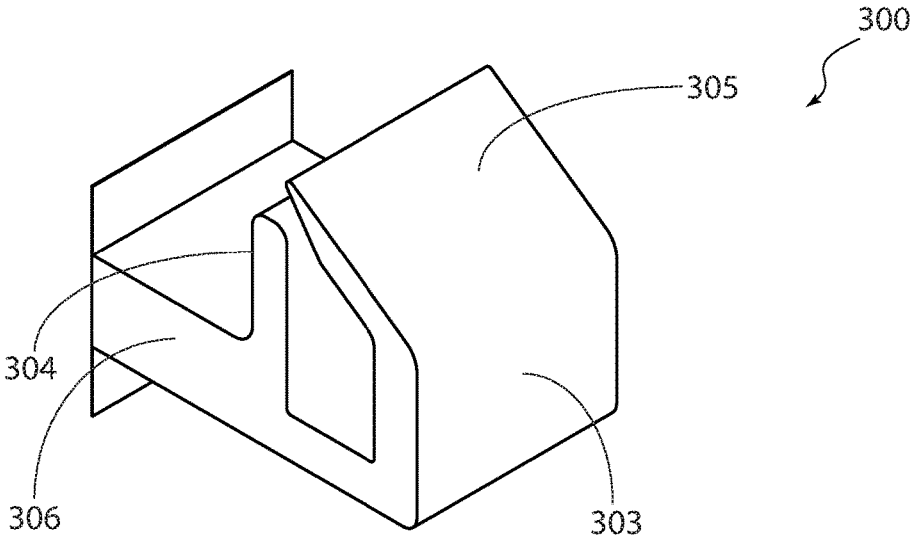

Turning now to the next set of figures, FIG. 33-FIG. 34 illustrate a bottom perspective view, a side view, and top perspective view, respectively, of a shield securing mechanism such as a clasp for an adjustable face shield in accordance with some exemplary embodiments of the present invention. More specifically, these views depict shield a securing mechanism or clasp 300. In exemplary embodiments, clasp 300 protrudes from ne or more surfaces of a structure of the adjustable face shield in order to secure a transparent face shield to the frame or portion thereof. In exemplary embodiments, clasp 300 is situated at an anterior region of a brim extension in accordance with the present invention, such as brim extension 102 (see for example, clasp 117 of brim extension 102 in the previous figures).

Clasp 300 may be constructed of any material suitable for rigidity and stability while securing a transparent face shield or portion thereof within clasp 300. Clasp 300 may include, without limitation a region such as an aperture 301 adapted to receive a portion of a face shield—typically an edge that may be received within the aperture 301 (as shown in FIG. 12, for example). In order for the edge or other portion of the transparent shield to be secured within aperture 301, clasp 300 may include a base 302 an anterior wall 303, a posterior wall 304, and an angled retaining member 305 that encapsulates or partially encloses aperture 301. In exemplary embodiments, retaining member 305 may be an angled wall that leaves a small opening between retaining member 305 and posterior wall 304. In some exemplary embodiments, a protruding member 306 extends clasp 300 away from the structural component to which it is attached, such as for example, a portion of shield support 109 of brim extension 102, or an arm 108 of brim frame 101.

Figure 35:
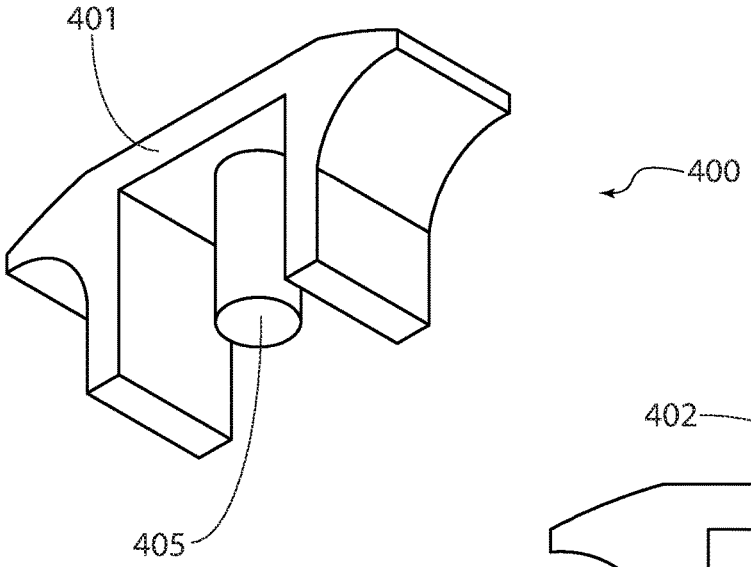
FIG. 35-FIG. 37 illustrate a bottom perspective view, a front view, and top perspective view, respectively, of a length extension securing mechanism for an adjustable face shield in accordance with some exemplary embodiments of the present invention.
Figure 36:
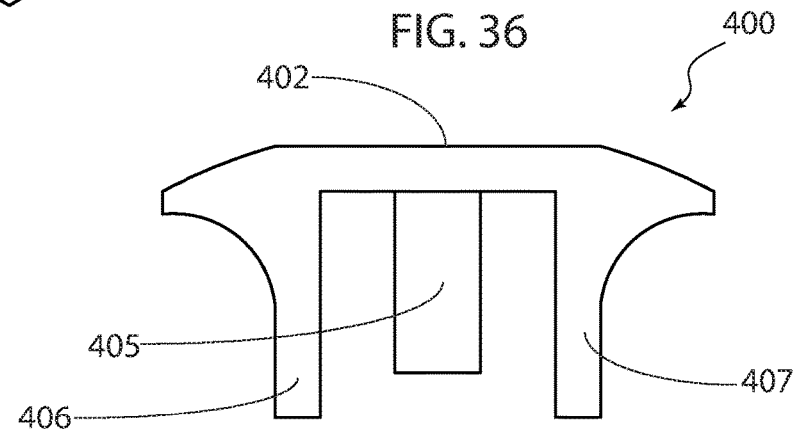
Figure 37:
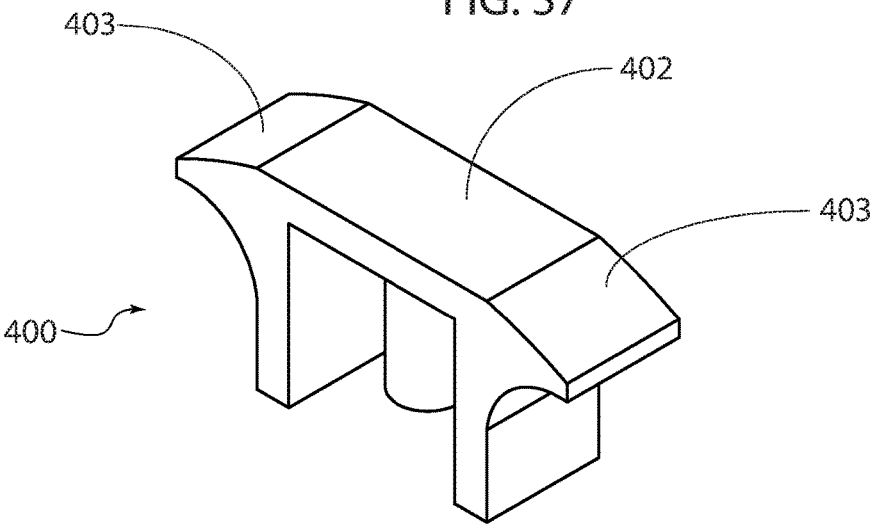

Turning now to the next set of figures, FIG. 35-FIG. 37 illustrate a bottom perspective view, a front view, and top perspective view, respectively, of a length extension securing mechanism for an adjustable face shield in accordance with some exemplary embodiments of the present invention. More specifically, FIG. 35-FIG. 37 illustrate adjustable tab 400, which in exemplary embodiments may comprise of a tab body 401, from which a user may hold the adjustable tab, and a protrusion 405, which interfaces with support member 111 (and more specifically with apertures 111*a* of support member 111 in order to secure brim extension at a desired length.

As may be appreciated by one of ordinary skill in the art, other devices or structural components may be employed in order to achieve the functionality of clasp 300. Similarly, a person of ordinary skill in the art will appreciate that other devices or structural components may be employed in order to achieve the functionality of adjustable tab 400. Moreover, with regards to assembly 200, or adjustable face shield 100, it is understood that other hardware, structural components, characteristics and features, and a wide range of suitable materials, may be used in lieu of or in addition to, or alternative to any of the same features or functionality of features that have been disclosed and described above.

Figure 38:
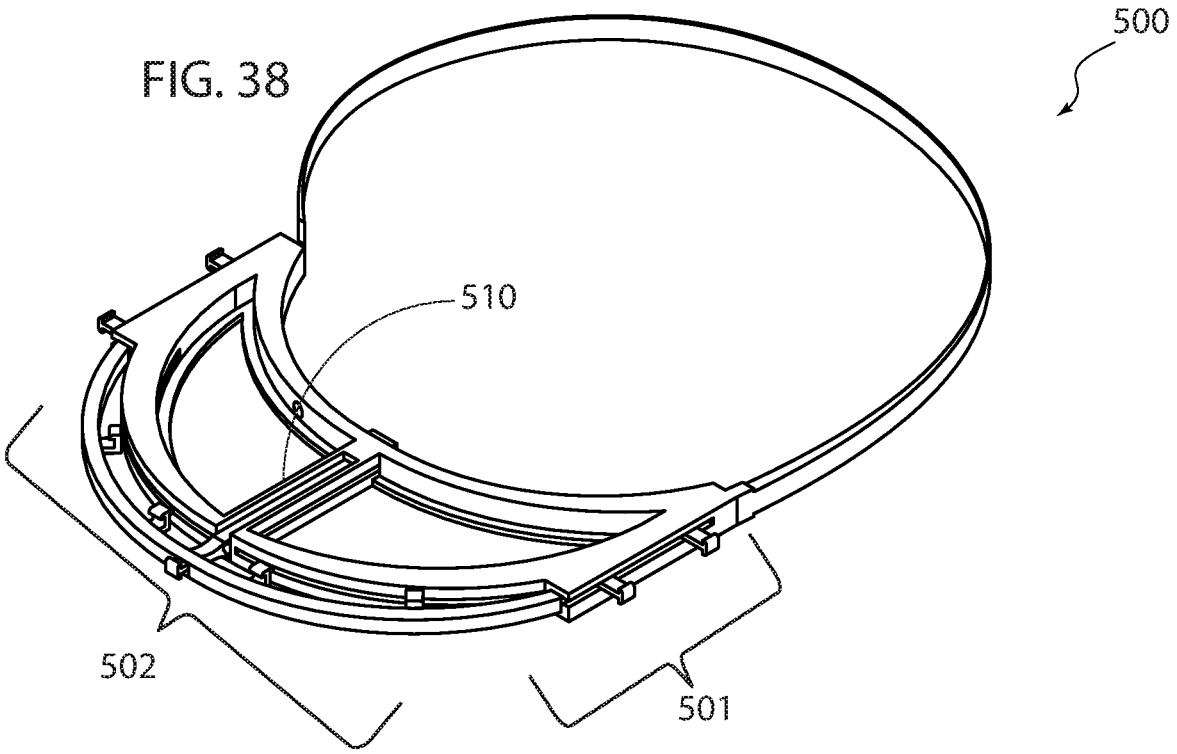
FIG. 38-FIG. 39 illustrate perspective and top views, respectively, of an adjustable face shield, in a collapsed position, in accordance with some exemplary embodiments of the present invention.
Figure 39:
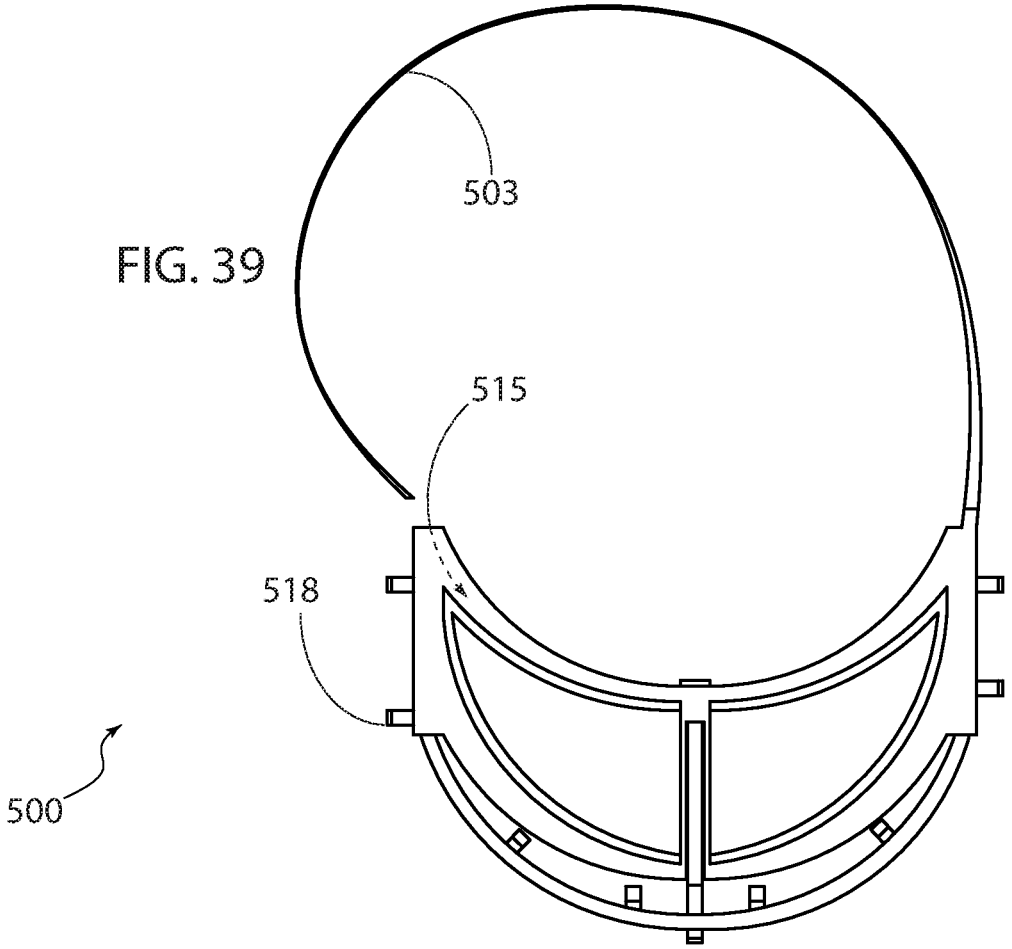
Figure 40:
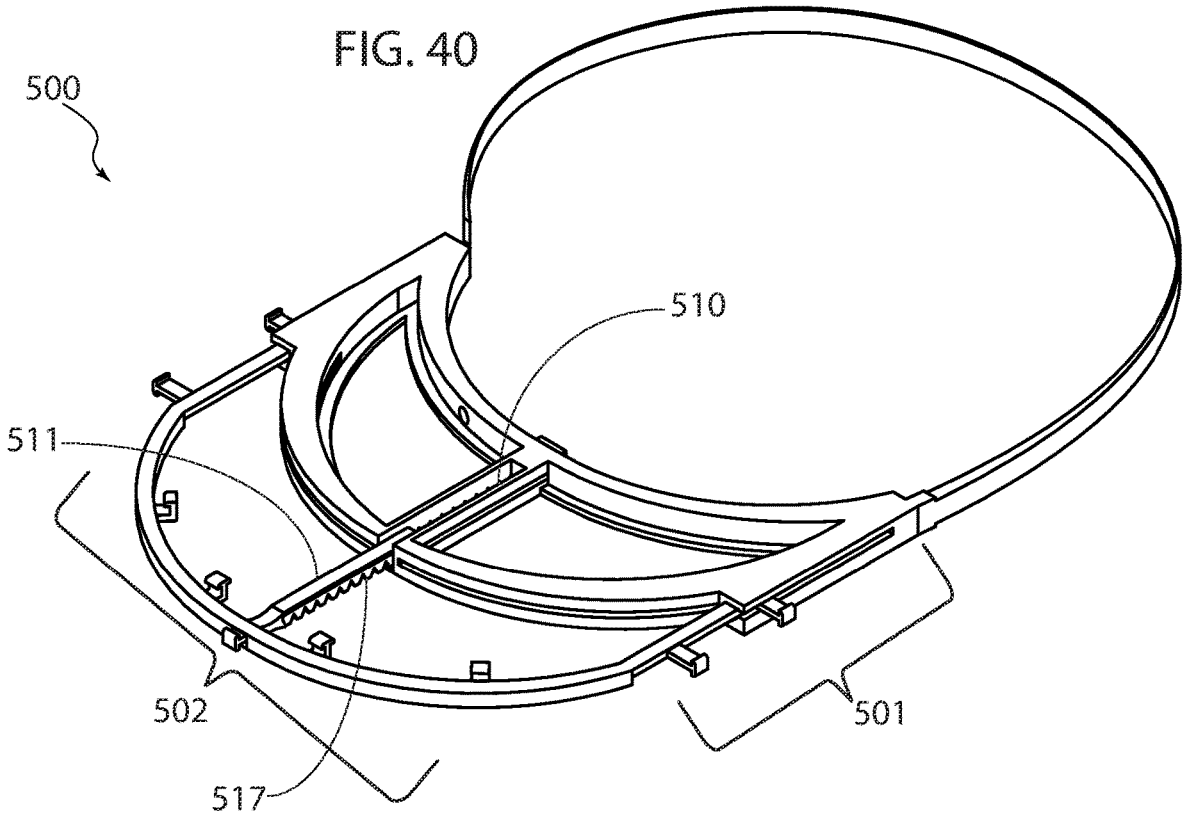
FIG. 40-FIG. 41 illustrate perspective and top views, respectively, of an adjustable face shield, in an expanded position, in accordance with some exemplary embodiments of the present invention.
Figure 41:
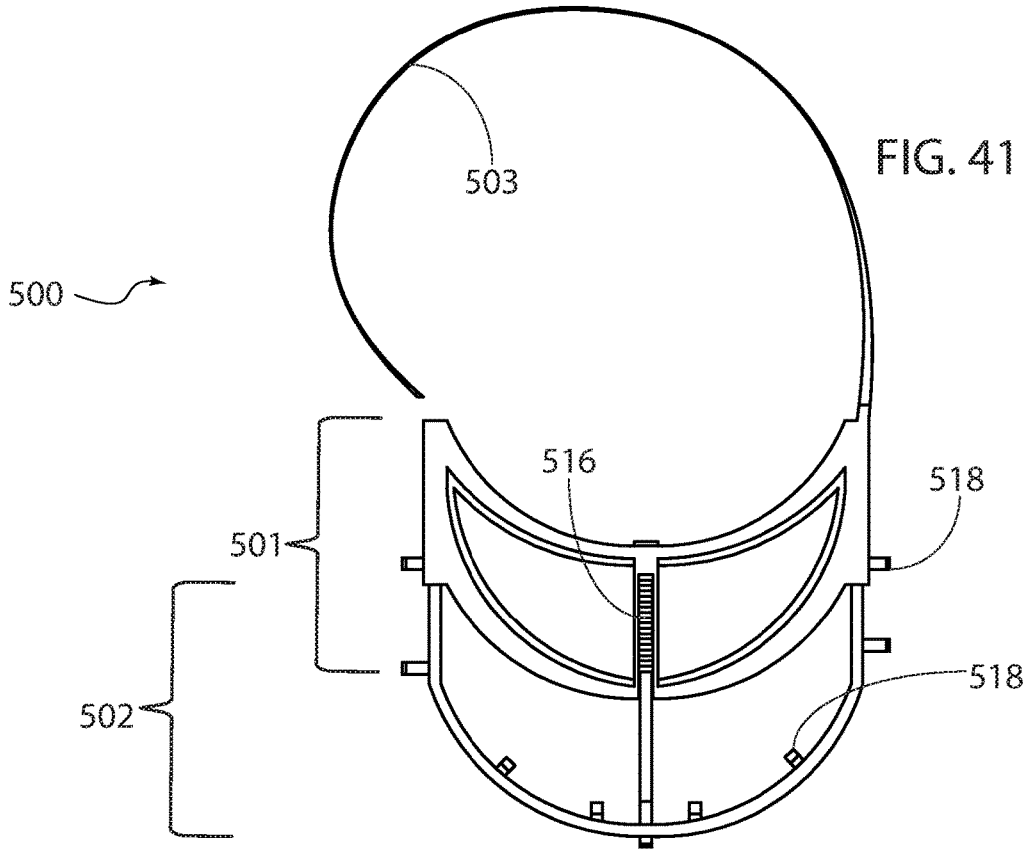

Turning now to the remaining figures, FIG. 38-FIG. 41 illustrate an exemplary embodiment of the present invention, in which the headband is structured differently as the headband 103 described above. More specifically, FIG. 38-FIG. 39 illustrate perspective and top views, respectively, of an adjustable face shield 500 in a collapsed position; and FIG. 40-FIG. 41 illustrate perspective and top views, respectively, of adjustable face shield 500 in an expanded position.

In this exemplary embodiment, adjustable face shield 500 may comprise: a headband 503 for securing adjustable face shield 500 to a wearer's head; a brim extension 502 adapted to removably couple to a transparent shield (not shown); and a brim frame 501 that includes a channel 510 adapted to register with a support member 511 of the brim extension 502 at an anterior region of the brim frame 501, wherein the support member 511 of the brim extension 502 extends and retracts within the channel 510 from the anterior region of the brim frame 501 to adjust a length of the adjustable face shield 500. In such exemplary embodiments, the handle 503 is a strap that engages with a portion of the brim frame 501, and more specifically with a second channel 515 that may be housed within a posterior region of brim frame 501.

In exemplary embodiments, rather than an aperture and tab system (as with previously disclosed embodiments), adjustable face shield 500 and more specifically the channel 510 of adjustable face shield 500, may employ a set of teeth 516, which register with a set of complementary teeth 517 on support member 511 in order to selectively secure a length of the brim extension 502 of the adjustable face shield 500. As may be appreciated by a person of ordinary skill in the art, the same means may be employed in other embodiments, and vice versa, without limiting or deviating from the scope of the present invention. In exemplary embodiments, a set of clasps 518 may be disposed along a perimeter of both brim frame 501 and brim extension 502, as shown. As may be appreciated by a person of ordinary skill in the art, the same means may be employed in other embodiments, and vice versa, without limiting or deviating from the scope of the present invention.

Versions of the devices discussed above in accordance with the present invention, may be constructed from a wide range of materials, including those mentioned in this disclosure, but also from other materials that may be suitable for light weight, yet sturdy constructions for a protective face shield. Any means of constructions may be employed without deviating from the scope of the present invention, including without limitation, injection molding, compression molding, three-dimensional printing, or any other means of creating the structural components of the embodiments of the present invention described above.

The foregoing detailed description has set forth various embodiments of the devices and/or examples. Insofar as such examples contain one or more functions and/or operations, it will be understood by those within the art that each function and/or operation within such examples may be implemented, individually and/or collectively, by a wide range of hardware.

Those skilled in the art will recognize that it is common within the art to describe devices in the fashion set forth herein, and thereafter use engineering practices to integrate such described into other face shield. That is, at least a part of the devices and/or processes described herein may be integrated into an orthodontic system via a reasonable amount of experimentation.

The subject matter described herein sometimes illustrates different components contained within, or connected with, other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

An adjustable face shield has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. An adjustable face shield, comprising:

a headband for securing the adjustable face shield to a wearer's head;

a brim extension adapted to receive a transparent shield adapted to cover a wearer's face; and a brim frame extending from the headband, the brim frame including a channel at a center region of the brim frame adapted to register with a support member of the brim extension at an anterior region of the brim frame, wherein the support member of the brim extension is adapted to:

telescopically extend and retract within the channel from the anterior region of the brim frame, and;

enable a user to select one of a plurality of discrete length adjustment settings of the brim extension to adjust a length of the adjustable face shield, wherein the brim extension and the brim frame are arched along a similar plane such that both the brim extension and the brim frame are configured to extend across a forehead of the wearer.

2. The adjustable face shield of claim 1, wherein the brim frame comprises:

a posterior support, an anterior support, and a central support situated at a center region of the brim frame connecting the posterior support to the anterior support, wherein the central support houses the channel adapted to register with the support member of the brim extension.

3. The adjustable face shield of claim 1, wherein the brim extension further includes:

a shield support adapted to receive the transparent shield; and a pair of arms extending posteriorly from terminal ends of the shield support, wherein the support member that is adapted to register within the channel of the brim frame extends posteriorly from the shield support.

4. The adjustable face shield of claim 2, wherein the brim frame further comprises exterior channels extending a length of a side region of the brim frame, each of the exterior channels adapted to receive an arm of the brim extension.

5. The adjustable face shield of claim 1, wherein the support member includes the plurality of discrete length adjustment settings for enabling the user to adjust the length of the adjustable face shield.

6. The adjustable face shield of claim 1, wherein the headband comprises headband arms extending posteriorly from the brim frame adapted to wrap around a portion of the wearer's head, and apertures at terminal ends of each of the headband arms, the apertures for receiving a strap to tighten the headband.

7. The adjustable face shield of claim 1, wherein the transparent shield is removably coupled to the brim extension.

8. The adjustable face shield of claim 1, wherein the transparent shield comprises an optical coating.

9. The adjustable face shield of claim 1, wherein the brim frame is integral with the headband.

10. The adjustable face shield of claim 1, further comprising a length adjustment tab for securing the brim extension at a selected length.

11. An adjustable face shield, comprising:

a headband for securing the adjustable face shield to a wearer's head;

a brim extension;

a transparent shield adapted to cover a wearer's face and removably coupled to the brim extension; and a brim frame extending from the headband, the brim frame including a channel at a center region of the brim frame adapted to register with a support member of the brim extension at an anterior region of the brim frame, wherein the support member of the brim extension is adapted to telescopically extend and retract within the channel from the anterior region of the brim frame, and to enable a user to select one of a plurality of discrete length adjustment settings of the brim extension to adjust a length of the adjustable face shield, wherein the brim extension and the brim frame are arched along a similar plane such that both the brim extension and the brim frame are configured to extend across a forehead of the wearer.

12. The adjustable face shield of claim 11, wherein the brim frame comprises:

a posterior support, an anterior support, and a central support situated at a center region of the brim frame connecting the posterior support to the anterior support, wherein the central support houses the channel adapted to register with the support member of the brim extension.

13. The adjustable face shield of claim 12, wherein the brim extension further includes:

a shield support adapted to receive the transparent shield; and a pair of arms extending posteriorly from terminal ends of the shield support, wherein the support member that is adapted to register within the channel of the brim frame extends posteriorly from the shield support.

14. The adjustable face shield of claim 13, wherein the brim frame further comprises exterior channels extending a length of a side region of the brim frame, each of the exterior channels adapted to receive an arm of the brim extension.

15. The adjustable face shield of claim 14, wherein the exterior channels are formed by upper and lower walls extending from an upper region and a lower region of the anterior support, and encapsulating walls that at least partially enclose an exterior region of the anterior support forming the exterior channels.

16. The adjustable face shield of claim 15, wherein each of the pair of arms of the brim extension includes one or more lateral clasps extending from a side region of each arm, the one or more lateral clasps adapted to secure the transparent shield to the brim extension.

17. The adjustable face shield of claim 1, further comprising a tab configured to be selectively secured to one of the plurality of discrete length adjustment settings of the brim extension.

18. The adjustable face shield of claim 11, further comprising a tab configured to be selectively secured to one of the plurality of discrete length adjustment settings of the brim extension.

19. The adjustable face shield of claim 1, further comprising a pair of apertures adjacent to the support member of the brim extension wherein the pair of apertures are covered with a pair of respective shields or a pair of respective telescoping shields.

20. The adjustable face shield of claim 11, further comprising a pair of apertures adjacent to the support member of the brim extension covered with a pair of respective shields or a pair of respective telescoping shields.

* * * * *